US012376631B2

(12) United States Patent
Barkshire et al.

(10) Patent No.: US 12,376,631 B2
(45) Date of Patent: Aug. 5, 2025

(54) FASHIONABLE HIGH-VISIBILITY SAFETY APPAREL

(71) Applicants: Jeffrey Garre Barkshire, Puyallup, WA (US); Thomas John Erdmann, Bonney Lake, WA (US)

(72) Inventors: Jeffrey Garre Barkshire, Puyallup, WA (US); Thomas John Erdmann, Bonney Lake, WA (US)

( * ) Notice: Subject to any disclaimer, the term of this patent is extended or adjusted under 35 U.S.C. 154(b) by 0 days.

(21) Appl. No.: 18/404,604

(22) Filed: Jan. 4, 2024

(65) Prior Publication Data

US 2024/0251887 A1 Aug. 1, 2024

Related U.S. Application Data

(62) Division of application No. 15/187,645, filed on Jun. 20, 2016, now Pat. No. 11,925,219.

(60) Provisional application No. 62/181,504, filed on Jun. 18, 2015.

(51) Int. Cl.

| | |
|---|---|
| ***A41D 13/01*** | (2006.01) |
| ***A41D 27/08*** | (2006.01) |
| *A41D 1/04* | (2006.01) |

(52) U.S. Cl.

CPC ..... *A41D 13/01* (2013.01); *A41D 27/085* (2013.01); *A41D 1/04* (2013.01); *A41D 2200/20* (2013.01)

(58) Field of Classification Search

None

See application file for complete search history.

(56) References Cited

U.S. PATENT DOCUMENTS

| | | | |
|---|---|---|---|
| 2,462,361 | A | 2/1949 | Cassens |
| 3,837,007 | A | 9/1974 | Girest |
| 3,849,804 | A | 11/1974 | Rakow |

(Continued)

FOREIGN PATENT DOCUMENTS

WO 2005063068 A1 7/2005

OTHER PUBLICATIONS

"Adding Sides to a Skinny T-Shirt". Crafty Staci. URL="https://www.craftystaci.com/blog/adding-sides-to-a-skinny-t-shirt". Accessed Aug. 23, 2024. Published Oct. 7, 2013. (Year: 2013).*

(Continued)

*Primary Examiner* — Jameson D Collier

(74) *Attorney, Agent, or Firm* — Fargo Patent & Business Law; Thomas Kading; Joshua Krank

(57) ABSTRACT

Embodiments of the invention comprise a garment; a first design comprising fluorescent material placed on the garment, wherein the first design is externally visible when the garment is worn by a wearer; a second design comprising reflective material overlaid on the first design to create a resulting design, wherein the resulting design provides 360 degree external visibility of the wearer when the garment is worn by the wearer; and wherein the resulting design is an artistic expression. Other embodiments comprise the steps of: creating a design, wherein the design is an artistic expression and comprises a first partial design and a second partial design; transferring the first partial design to a garment comprised of clothing fabric using a fluorescent material; and transferring the second partial design to the garment using a reflective material, wherein all the materials cause a wearer of the garment to have 360 degree external visibility.

12 Claims, 19 Drawing Sheets

(56) References Cited

U.S. PATENT DOCUMENTS

| | | | | |
|---|---|---|---|---|
| 4,815,146 | A | 3/1989 | Theewis | |
| 4,868,019 | A | 9/1989 | Knickerbocker | |
| 5,054,125 | A | 10/1991 | Snedeker | |
| 5,588,156 | A | 12/1996 | Panton, Jr. | |
| 5,605,761 | A | 2/1997 | Burns | |
| 5,691,846 | A | 11/1997 | Benson, Jr. | |
| 6,148,442 | A | 11/2000 | Porter | |
| 6,153,128 | A | 11/2000 | Lightle | |
| 6,805,957 | B1 | 10/2004 | Santos | |
| 6,859,941 | B2 * | 3/2005 | Koppes | A41D 13/01 2/81 |
| 7,175,901 | B1 | 2/2007 | Sagar | |
| 7,396,579 | B2 | 7/2008 | Owusu | |
| 7,793,360 | B2 | 9/2010 | Blauer | |
| 7,845,018 | B1 | 12/2010 | Greer | |
| D746,552 | S * | 1/2016 | Brown | D2/717 |
| D773,150 | S * | 12/2016 | Hackenberg | D2/717 |
| 9,854,856 | B1 | 1/2018 | Baldonado | |
| 11,925,219 | B2 * | 3/2024 | Barkshire | A41D 27/085 |
| 2002/0152533 | A1 | 10/2002 | Lesley | |
| 2003/0150043 | A1 | 8/2003 | Koppes | |
| 2004/0018790 | A1 | 1/2004 | Kumar | |
| 2004/0209051 | A1 | 10/2004 | Santos | |
| 2004/0216214 | A1 | 11/2004 | Grilliot | |
| 2004/0227997 | A1 | 11/2004 | Owusu | |
| 2005/0044604 | A1 | 3/2005 | Salem | |
| 2005/0060784 | A1 | 3/2005 | Emeth | |
| 2005/0155130 | A1 | 7/2005 | Grilliot | |
| 2005/0257308 | A1 | 11/2005 | Willis | |
| 2006/0034064 | A1 | 2/2006 | Kanzler | |
| 2008/0155732 | A1 | 7/2008 | Vassel | |
| 2008/0220678 | A1 | 9/2008 | Neudeck | |
| 2009/0199328 | A1 | 9/2009 | VanSpeybroeck | |
| 2009/0248193 | A1 | 10/2009 | Basheer | |
| 2010/0108247 | A1 | 5/2010 | King | |
| 2010/0269242 | A1 | 10/2010 | Stubiger | |
| 2011/0075401 | A1 | 3/2011 | Torres | |
| 2012/0204309 | A1 | 8/2012 | Sullivan | |
| 2013/0031694 | A1 | 2/2013 | Foster | |
| 2013/0205468 | A1 | 8/2013 | Ceo | |
| 2014/0059749 | A1 | 3/2014 | Fofana | |
| 2015/0116321 | A1 | 4/2015 | Fortner | |
| 2015/0230525 | A1 | 8/2015 | DeMille | |
| 2016/0366954 | A1 * | 12/2016 | Barkshire | A41D 27/085 |
| 2024/0138499 | A1 * | 5/2024 | Barkshire | A41D 27/085 |
| 2024/0156186 | A1 * | 5/2024 | Barkshire | A41D 13/01 |

OTHER PUBLICATIONS

"Anvil Ringer T-Shirt". Ooshirts. URL="https://www.ooshirts.com/t-shirts/short-sleeve-shirts/anvil-ringer". Accessed Aug. 23, 2024. Published at least as of Jul. 28, 2013. (Year: 2013).*

3M Scotchlite Reflective Material—ANSI/ISEA 107-2004 Made Easy: A Quick Reference to High-Visibility Safety Apparel (Year: 2004).

Stars in stripes: Celebs with patriotic style. CNN entertainment. URL = https://www.cnn.com/2013/07/03/showbiz/celebrity-news-gossip-/stars-stripes-celebs/index.html. Accessed May 4, 2022. (Year; 2013).

WWII War Paint: How Bomber-Jacket Art Emboldened Our Boys. URL = https://www.collectorsweekly.com/articles/wwii-war-paint-how-bomber-jacket-art-emboldened-our-boys/. Accessed May 4, 2022. (Year: 2012).

Cowabunga! Five Pizza Print Tees to Tease Your Fashion Palate. URL = https://www.yournextshoes.com/pizza-print- tees/. Accessed May 4, 2022 (Year: 2014).

* cited by examiner

FASHIONABLE HIGH-VISIBILITY SAFETY APPAREL

COPYRIGHT NOTICE

This disclosure is protected under United States and/or International Copyright Laws. © 2015 SafetyShirtz. All Rights Reserved. A portion of the disclosure of this document contains material that is subject to copyright protection. The copyright owner has no objection to the facsimile reproduction by anyone of the patent document or the patent disclosure, as it appears in the Patent and/or Trademark Office patent file or records, but otherwise reserves all copyrights whatsoever.

PRIORITY CLAIM

CROSS REFERENCE TO RELATED APPLICATION[S]

This application claims the priority as a continuation of U.S. Nonprovisional Patent Application No. 15/187,645 filed Jun. 20, 2016 (01732-ERD) which issued as U.S. Pat. No. 11,925,219 on Mar. 12, 2024 which claims priority to U.S. Provisional Patent Application No. 62/181,504 filed Jun. 18, 2015. Each of the aforementioned patent applications, and any applications related thereto, are herein incorporated by reference in their entirety.

FIELD OF INVENTION

This invention relates generally to work safety apparel and, more specifically, to fashionable and comfortable everyday high-visibility apparel.

BACKGROUND OF THE INVENTION

To improve visibility and reduce the chances of injury through accidents, certain people will wear enhanced visibility apparel (i.e., any garment of any color that may have reflective or retroreflective striping added to it in any configuration), high-visibility safety garments (i.e., garments compliant with certain safety regulations), and high-visibility personal protective equipment (e.g., gloves, vests, jackets, helmets, overalls, etc.). Hereinafter, the terms clothing, garment, apparel, equipment, and accessory are used interchangeably. Similarly, the terms enhance visibility and high-visibility will be collectively referred to as high-visibility, and the terms reflective materials and retroreflective materials will be collectively referred to as reflective material.

To fulfill the purpose of providing visibility to the wearer, the configuration of high-visibility apparel is generally a solid block of color, e.g., florescent orange, with two or more reflective bands across the torso. The conventional high-visibility vest is generally made of a plastic, polyester, and/or mesh for durability, reuse, and breathability. Wearers of high-visibility apparel generally wear it over their regular clothes and only during the activity/work hours. The status quo of conventional high-visibility apparel is sufficient to serve its distinct purpose and does not appear to have any major flaws in providing that utility, and as such, conventional high-visibility apparel is widely used without change from generation to generation.

Prior to the present invention, there has been no perceived need for a garment that meets high-visibility safety requirements while also simultaneously providing the aesthetics and comfort of everyday clothing wear, and therefore, such garments have not been manufactured, marketed, or even conceived.

SUMMARY OF THE INVENTION

The present application discloses high-visibility apparel that goes beyond the sole utility of visibility/safety provided by traditional prior art safety apparel. The present invention teaches a single integrated unitary garment that meets high-visibility safety requirements while also simultaneously providing the aesthetics and comfort of everyday clothing wear to increase and promote compliance with safety regulations and to provide the wearer the ability to exhibit his or her sense of fashion, style, and identity.

Compared to the status quo of high-visibility safety apparel, the specific combinations of the particular elements in the present invention can greatly enhance the convenience and quality of life of users/wearers of such apparel as well as companies and employers which may or may not incorporate the use of high-visibility safety apparel in their businesses. Embodiments of the present invention will provide unexpected marketing opportunities and benefits to all.

BRIEF DESCRIPTION OF THE DRAWINGS

Preferred and alternative examples of the present invention are described in detail below with reference FIGS. 1A through 14.

DETAILED DESCRIPTION OF A PREFERRED EMBODIMENT

Figure 1A:
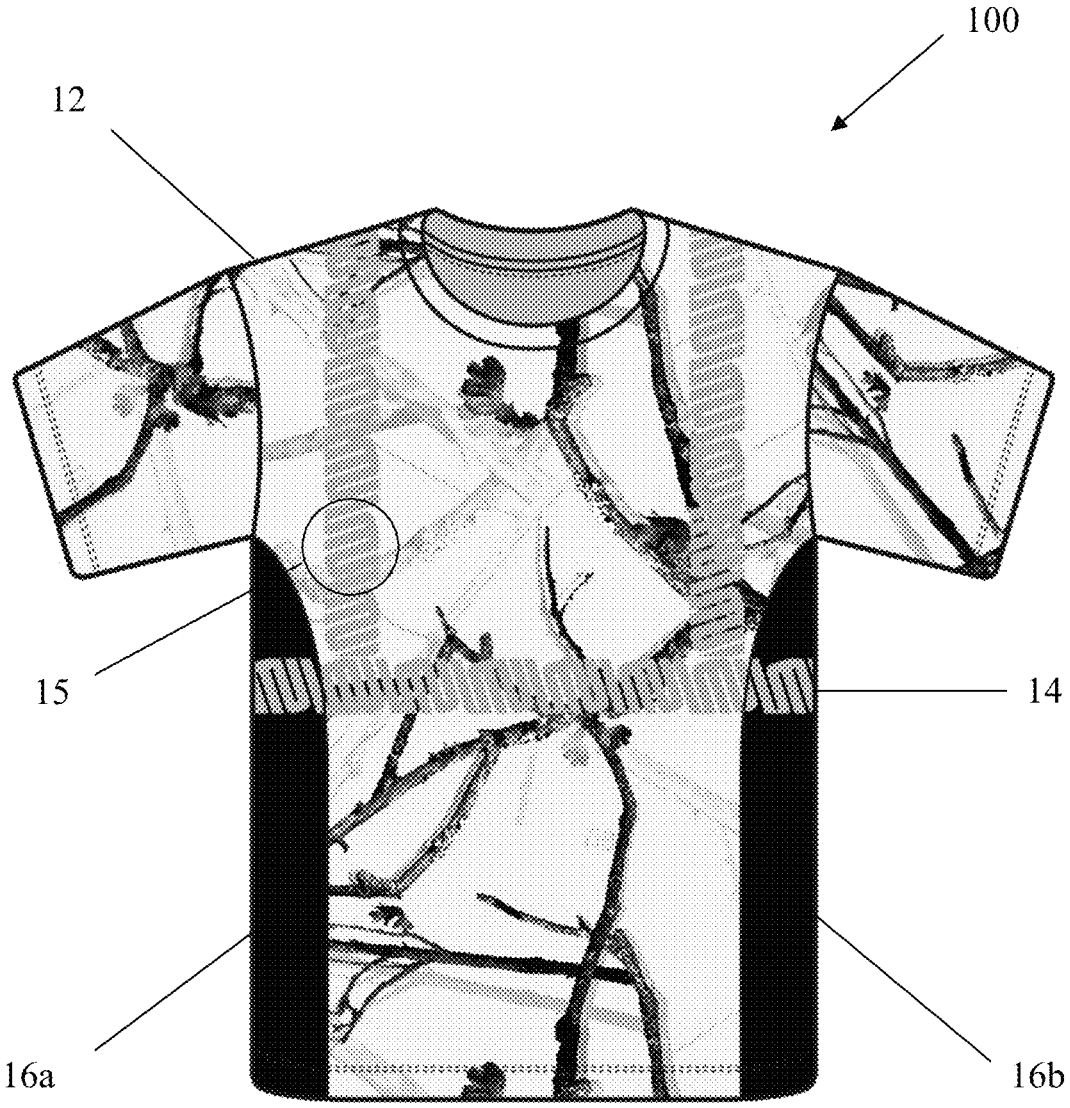
FIG. 1A depicts one embodiment of the present invention and illustrates at-shirt with a first design comprising yellow-green fluorescent material with an all-over tree branch print, a second design comprising three bands of reflective material around the upper torso, wherein each band is comprised of a repeating SS® logo, and a third design comprising two black side panels.

This application is intended to describe one or more embodiments of the present invention. It is to be understood that the use of absolute terms, such as "must," "will," and the like, as well as specific quantities, is to be construed as being applicable to one or more of such embodiments, but not necessarily to all such embodiments. As such, embodiments of the invention may omit, or include a modification of, one or more features or functionalities described in the context of such absolute terms.

The American National Standards Institute (ANSI), the International Safety Equipment Association (ISEA), and other similar international, federal, state, local or business organizations have many standards and requirements pertaining to high-visibility certification for those working in particular industries or participating in certain activities, such as roadway workers, construction workers, warehouse employees, loggers, hunters, fisherman, etc.

In some circumstances, high-visibility may be crucial to the safety of the person wearing the high-visibility apparel as well as those surrounding him/her. Accordingly, depending on the degree of danger, high-visibility apparel may be required, recommended, or optional. To achieve the function of high-visibility, such apparel generally consists of a solid bright color (most commonly yellow or orange) with or without reflective stripes.

For example, industrial workers along roadways, railways, construction sites, airport tarmacs, intersections and the like are often required or recommended to wear high-visibility apparel. Similarly, private users like hunters may be required to wear designated high-visibility apparel to help prevent accidental shooting. These and other occupational workers or a hobbyists may own conventional high-visibility apparel or be provided one. Similarly, employers and companies operating in these industries may keep an inventory of multiple sets of such apparel, in order to provide them to the workers or participants.

High-visibility apparel has served and continues to serve a single distinct and utilitarian purpose. Due to the distinct purpose and aim to be eye-catching, high-visibility clothing is simple, utilitarian, and typically worn only when required or highly recommended. For example, when high-visibility safety garments are an occupational requirement, people will typically place the safety garments over their clothing while working, but remove them after work, and return home or elsewhere in their normal clothing. Other times, high-visibility safety apparel is merely recommended or optional for a recreational activity, and some participants will choose not to wear it or wear it reluctantly. It is clear that high-visibility safety apparel is not—and does not need to be—a part of the general public's first choice of wardrobe. Rather, high-visibility garments are treated like life jackets on a boat or airplane, only worn in limited circumstances, and/or are more akin to an occupational uniform donned on and off.

However, in all of the examples discussed above and other examples not described here, people's safety will be improved by wearing high-visibility apparel. For example, outdoor work and activities may be performed at night or when light levels are low such as dawn, dusk, or during inclement weather. In other circumstances, visibility may be obstructed by other natural or manmade obstacles in the surroundings even in bright daylight. Visibility problems can result in many deaths and injuries, especially if there is exposure to vehicles, equipment, or other hazards or high risk situations. This is true for even everyday activities such as walking, running, biking, hiking, motor vehicle racing and other sports. People participating in such and like activities could benefit from increased visibility.

If safety and visibility have these benefits, why is it that people are so reluctant to don high-visibility garments or only wear them for the short periods when such garments are required? One reason is because regardless of the important safety feature that high-visibility safety garments provide, most people are also concerned about fashion and comfort. As previously discussed, the conventional high-visibility apparel generally consists of bright yellow and/or orange reflective shirts, vests, bibs, coveralls, hats, gloves, or pants made of bulky and/or non-breathable materials. Conventional high-visibility garments simply are not constructed with fashion in mind, but in fact, just the opposite. For example, advertisements boast characteristics such as "[w]ith our great selection of high-visibility work-wear, you'll be sticking out like a sore thumb, which will keep the rest of you from being sore from any avoidable accidents."[1] See, e.g., http://workingperson.com/workwear-1/high-visibility-clothes.html. High-visibility apparel is meant, exclusively, to keep the wearer safe and highly visible, as the name suggests, rather than comfortable or fashionable.

However, people typically do not want to "stick out like a sore thumb" in daily life and are deterred from wearing gaudy shiny orange safety apparel when it is not necessary to do so. As previously mentioned, when the safety apparel is only recommended or optional, some people will choose not to wear it even though such apparel provides potentially life-saving safety benefits. As an example of this point, some athletic apparel will have slivers or patches of reflective properties to reflect in environments of low light, but purposefully remain inconspicuous under normal daylight. For instance, IllumiNITE® fabric created by Reflective Technologies utilizes miniature glass beads to reflect light back at its source. However, IllumiNITE-treated fabrics are indistinguishable from untreated fabrics in sunlight, rendering them unsuitable for increasing daytime visibility. Reflec PLC's U.S. Pat. No. 7,175,901 for Retroreflective Inks discloses a similar method.

In addition, because conventional high-visibility apparel is designed solely with safety functions in mind, conventional high-visibility apparel comes only in a couple of basic variations and does not allow for unique self-expression or pleasurable everyday wear. For instance, U.S. Pat. No. 6,148,442 for Porter discloses a layered set of reflectorized and/or safety colored work clothes. Nonetheless, each layer of the apparel (vest, coveralls, etc.) looks identical with a solid block of color with two vertical strips along the left and right sides of the body. Accordingly, the present inventors have discovered that there is a desire and need for high-visibility apparel that also goes beyond mere utility. As such, this application teaches how to make these lifesaving garments with style or as a form of fashion that satisfies the aesthetics and comfort of everyday clothing wear that may increase and promote, among other things, compliance with safety regulations.

Embodiments of the present invention bridge the gap between traditional safety apparel and style-forward lifestyle clothing by making safety apparel fashionable, comfortable, and more aesthetically appealing. Embodiments of the present invention function both as high-visibility safety wear and everyday fashionable apparel, which can facilitate and cause more people to wear high-visibility apparel.

An embodiment of the present invention relates to high-visibility apparel (including but not limited to shirts, hooded sweatshirts, jackets, pants, hats, and other headwear, body wear, foot wear, or accessories) that is constructed to comply with ANSI/ISEA 107-1020 and other standards. But rather than the traditional and conventional high-visibility features that cause the user to "stick out like a sore thumb," an embodiment of the present invention incorporates high-visibility features into the designs and configurations of the apparel so that the user effectively increases his/her visibility both during the daytime and nighttime, while maintaining a level of fashion and comfort.

Creating garments with this dual purpose in mind can increase the desire to wear the garments and, therefore, can increase and promote compliance with safety regulations. The resulting dual purpose garment can be usable at work and also away from work, and hunting and the like, which can also save money for the user. Wearers of high-visibility garments will not forget or be reluctant to wear such apparel, but may feel excited to wear embodiments and variations of the present invention to express themselves during work and other activities. High-visibility work apparel may also become a new avenue and marketing tool for businesses to utilize.

In a preferred embodiment of the present invention, the article of high-visibility apparel having the aesthetics to meet everyday clothing needs is a garment made from one or a combination of fabrics typically made for everyday clothing. Such fabrics include, but are not limited to, natural and synthetic fibers. Examples of natural fabrics are as follows: wool, cotton, linen, cotton-plant seed pods, fibers from silkworms, and flax. Examples of synthetic fabrics are as follows: nylon, spandex, rayon, polyester, and acrylic. Other embodiments of the present invention can be made of other materials such as plastics and other polymers, or a combination thereof. The apparel may be made of any suitable material currently known in the art or later discovered. Such fabrics and materials are hereinafter collectively referred to as clothing fabrics.

In a preferred embodiment, the article is designed such that it is aesthetically pleasing and/or something considered as a creative and/or artistic expression. Creative and/or artistic expressions include, without limitation: black and white or color outlines; abstract prints comprised of a blend of shapes, colors, and lines; shapes, photos, caricatures, and renderings of food, beverages, animals, people, buildings, and natural or man-made objects; animation, cartoon, or characters; zombie or apocalypse designs; geography and landscapes; words, logos, literature, equations, and typography; and gothic, vintage, and other designs.

In a preferred embodiment, the design is externally visible such that the wearer of the garment has visibility to others. In one embodiment of the present invention, the wearer may even be visible from one thousand feet (1000 ft.) away. In another embodiment, the wearer has 360 degree visibility. The design can be comprised of many layers or different design parts to create an ultimate or resulting design. Each layer or partial design can be made from different materials. The design can include bands that encircle the garment, for example, the torso areas, shoulder areas, or sleeves. The bands may vary in width. For example, the design can include 2 inch bands that are 1 inch apart.

The garment or the substrate coated onto the garment can comprise a reflective material, wherein the reflective material is grouped in different patterns and in various densities to form and/or complement a visible logo, alphabet or other graphic designs, including but not limited to camouflage patterns, repeating style patterns, plaid patterns, stripes, and other shapes. Reflective materials include but are not limited to fabric, ink/dye, or other laminate or heat-transfer materials. In one embodiment, the reflective material is at least ten inches squared (10 $in^2$). In another embodiment, the reflective material is at least two (2) inches wide.

Alternatively or in addition to the reflective material, the garment or the substrate coated onto the garment can comprise a fluorescent material intended to be highly conspicuous. Fluorescent colors include, but are not limited to, green, lime green, yellow green, orange, orange-red, and red. In a preferred embodiment, the fluorescent material is at least seventy-eight inches squared (78 $in^2$). Fluorescent material can also be grouped in different patterns and in various densities to form and/or complement the different designs and patterns mentioned above, and can also include, but are not limited to, fabric, ink/dye, or other laminate or heat-transfer materials.

The garment or the substrate coated onto the garment can also be a combination of reflective and fluorescent material, which is also known as "combined-performance material." In one embodiment of the present invention, the design is created with combined-performance material and is at least seventy-eight inches squared (78 $in^2$).

One skilled in the art would understand that various combinations of the different elements disclosed in this application can be formed and adjusted as required or recommended by current and future ANSI/ISEA standards. One skilled in the art would also understand that there are a variety of methods to combine and join different designs and/or different materials together into a single garment. For example, in one embodiment, the garment can be created from a single piece of fabric. In other embodiments, the garment can be a single fabric with other pieces of fabric sewn or glued to it and/or two or more fabrics joined together with additional pieces of fabric sewn or glued to them. Similarly, entire patterns can be created using dye-sublimation in some embodiments, while others, for example, could have additional designs screen-printed on as a second layer.

FIG. 1A illustrates one embodiment of the invention in which the garment is at-shirt 100. In this embodiment, the majority of the t-shirt 100 is comprised of a first design 12 that is an all-over tree branch print comprising yellow-green fluorescent material. One skilled in the art would understand that one could designate any variation of print and design to be printed, sewn, dyed or otherwise placed onto the garment. In addition, one skilled in the art would also understand that the total area of fluorescent material can be designed and adjusted accordingly by the manufacturer.

FIG. 1A also discloses a second design 14 comprising reflective material that is overlaid onto the first design 12. In this embodiment, the second design 14 comprises three bands: one horizontal band that completely encircles the torso and two vertical bands each joining the horizontal torso band from the front to the back over each shoulder. FIG. 1A illustrates that the second design 14 can further comprise design details like a repeating SS® logo 15. The embodiment in FIG. 1A also includes a third design comprising two black side panels 16*a* and 16*b*.

One skilled in the art will appreciate that the configuration of the reflective banding displayed in FIG. 1A (and each configuration of the other embodiments illustrated in this application) is an ANSI/ISEA-recommended configuration, which allows the garment to be self-certified by the manufacturer. While FIG. 1A demonstrates the standard ANSI/ISEA-certified reflective banding configuration in this embodiment of the present invention, many other configurations for the placement and design of the reflective banding are possible, especially in light of the various shapes and sizes of garments. In other embodiments not shown here, the reflective bands may be arranged in different configurations that surround the body or sleeves.

Moreover, while the pattern of the first design 12 illustrated in FIG. 1A is a more realistic depiction of tree branches, in other embodiments, the design can be more traditional outdoors themed camouflage patterns or more modern digital or urban patterns as well. The t-shirt 100 illustrated in FIG. 1A and in other embodiments of the invention not shown here, may have multiple variations such as a semi-opaque background element, or a solid element in certain locations of the clothing.

Figure 1B:
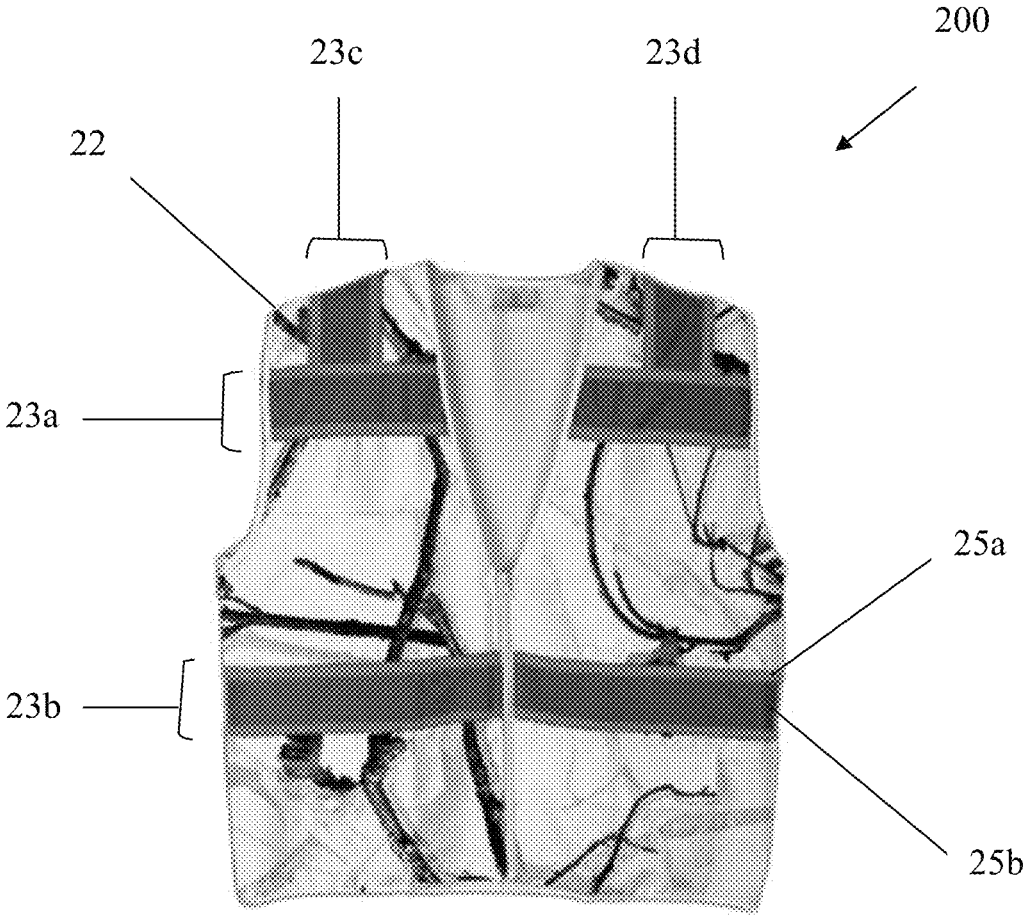
FIG. 1B depicts another embodiment of the present invention and illustrates a vest with a first design comprising green fluorescent material with an all-over tree branch print, and a second design comprising four bands of combination-performance material around the upper torso.

FIG. 1B illustrates another embodiment of the invention in which the garment is a vest 200. In this embodiment, the first design 22 is an all-over tree branch print comprising green fluorescent material. The second design comprises a combined-performance material made of orange-red fluorescent material 25*a* and reflective material 25*b*. In this embodiment, the second design comprises a first horizontal band 23*a* encircling the upper torso, a second horizontal band 23*b* encircling the lower section of the torso, and a third band 23*c* and fourth band 23*d* that each join the first horizontal band 23*a* from the front to the back over each shoulder in a vertical configuration.

Figure 2A:
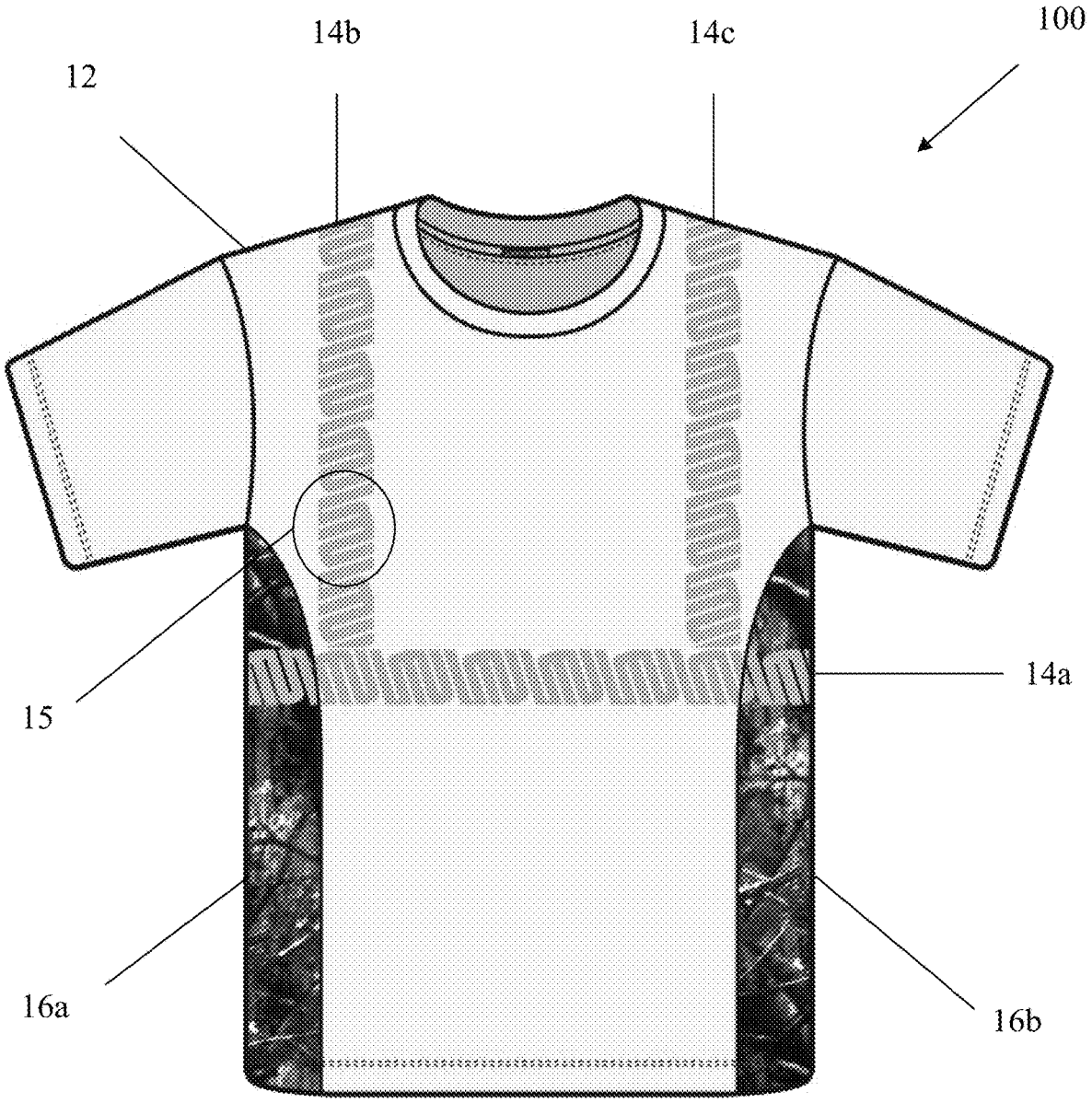
FIG. 2A depicts one embodiment of the present invention and illustrates a t-shirt with a first design comprising a solid block of yellow-green fluorescent material, a second design comprising three bands of reflective material around the upper torso, wherein each band is comprised of a repeating SS® logo, and a third design comprising two side panels with a realistic forest print.

FIG. 2A illustrates an alternate embodiment of the invention. In this embodiment, t-shirt 100 comprises of a first design 12 which is a single block of yellow-green florescent material. The second design 14 comprises of three bands of reflective material overlaid on the t-shirt 100: one horizontal band 14*a* that completely encircles the torso, one vertical band 14*b* joining the horizontal torso band from the front to the back over the right shoulder, and another vertical band 14*c* joining the horizontal torso band from the front to the back over the left shoulder. Each reflective band 14*a*, 14*b*, and 14*c* is formed through a sequence of repeating SS® logos 15. In other embodiments here and not shown, the reflective bands may have even more or fewer details. One skilled in the art would understand that any number of logos or other designs can be used to create banding or the outlining of other designs. FIG. 2A also discloses two side panels 16*a* and 16*b*, each having a third design of realistic forest print. Compare the pattern used in side panels 16*a* and 16*b* of this embodiment with that of the brighter and less dense tree branch design 12 in FIG.

A Also compare this with the black side panels in FIG. 1A One skilled the art would appreciate that there may be many different patterns that may be chosen to create the same configurations disclosed.

The t-shirt 100 illustrated in FIG. 2A, for example, may be worn by a user during hunting activity, where the user wishes to blend in with forest, but may also wish high-visibility, perhaps because it is either required or recommended. Alternatively and/or additionally, the t-shirt illustrated in FIG. 2A may also be worn by a construction worker who is required to have ANSI-compliant work wear, but wishes to express his or her love for the outdoors through the creative pattern along the side panels. As another possibility, the t-shirt may be worn as everyday apparel unrelated to its safety functions.

Figure 2B:
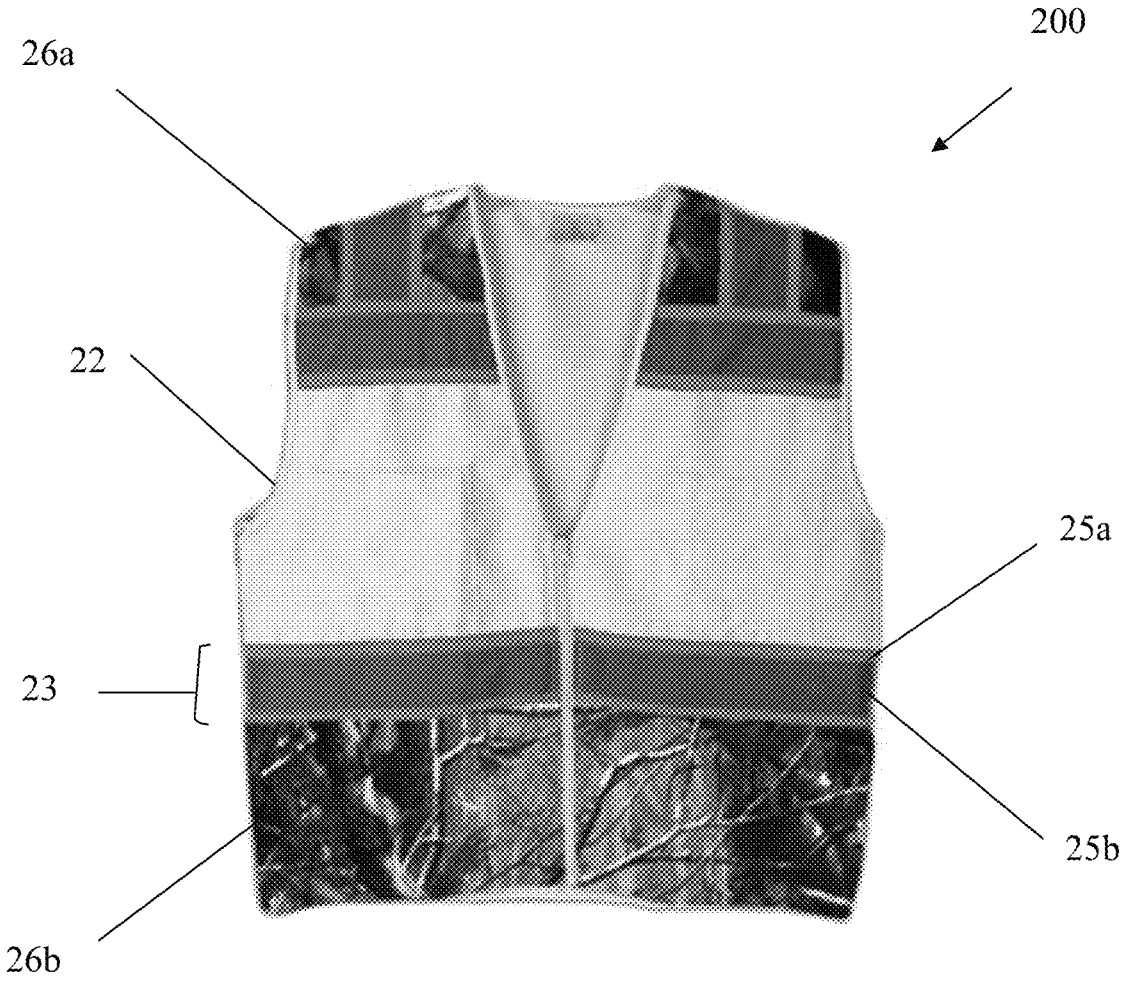
FIG. 2B depicts another embodiment of the present invention and illustrates a vest with a first design comprising a solid block of green fluorescent material, a second design comprising four bands of combined-performance material around the upper torso, and a third design comprising an upper panel and lower panel of realistic forest print.

FIG. 2B illustrates another embodiment of the invention that captures some of the elements in the t-shirt of FIG. 2A as well as the vest in FIG. 1B. In FIG. 2B, the vest 200 has a first design 22 which is a single block of green florescent material. The second design 23 comprises a combined-performance material made of orange-red fluorescent material 25*a* and reflective material 25*b*. In this embodiment, the second design 23 comprises two horizontal bands encircling the torso, and two vertical bands that each join the first horizontal band from the front to the back over each shoulder. The third design comprises a realistic forest print/pattern that is similar to the print/pattern in side panels of FIG. 2A. In this embodiment, the third design comprises two horizontal panels: a top horizontal panel 26*a* that spans across the upper chest and shoulders, and a bottom horizontal panel 26*b* that spans cross the waist area. One skilled in the art can appreciate that either top panel 26*a* or bottom panel 26*b* could have easily been comprised of the same print as first design 22. Similarly, one skilled in the art would understand that a fourth design or fifth design could have been incorporated into this embodiment to create further complexity and style in the garment.

Figure 3A:
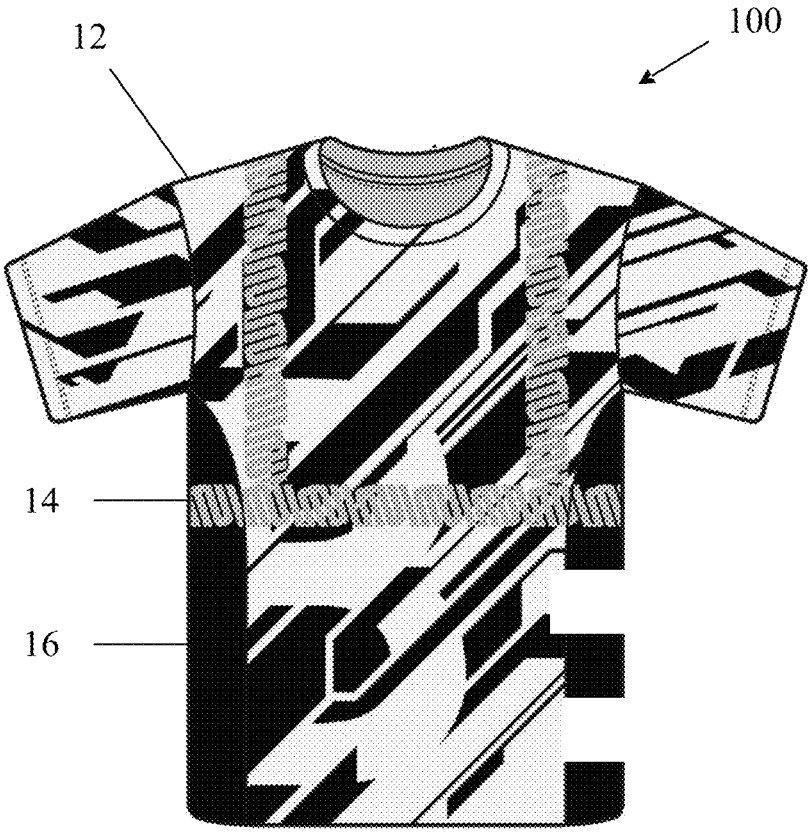
FIG. 3A depicts one embodiment of the present invention and illustrates at-shirt with a first design comprising geometric shapes formed by a yellow-green fluorescent material, a second design comprising three bands around the upper torso, wherein each band is comprised of a repeating SS® logo, and a third design comprising two black side panels.

FIG. 3A illustrates yet another embodiment of the invention where t-shirt 100 comprises a first design 12 comprising yellow fluorescent material grouped with non-fluorescent black material to form different geometric shapes on a t-shirt. This embodiment has a second design 14 comprising reflective material in a layout similar to previous embodiments, and a third design 16 comprising two black side panels. This embodiment may have a broad appeal and benefit for industrial and non-industrial users alike and can be worn for both business and pleasure. Industrial and non-industrial users now have a stylish option to use for activities from paving the road to walking the dog.

Figure 3B:
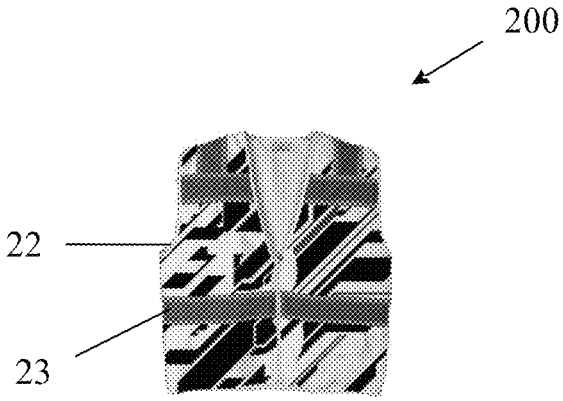
FIG. 3B depicts another embodiment of the present invention and illustrates a vest with a first design comprising geometric shapes formed by a green fluorescent material, and a second design comprising four bands of combined-performance material around the upper torso.

FIG. 3B illustrates another embodiment of the invention with similar components and design elements as those displayed in FIG. 3A, with slight differences in the configuration and style of reflective banding and bright coloring. Generally, the vest 200 has a first design 22 comprising green fluorescent material grouped with non-fluorescent black material to form different geometric shapes, and a second design 23 comprising combined-performance material in a layout similar to previous embodiments.

Figure 4A:
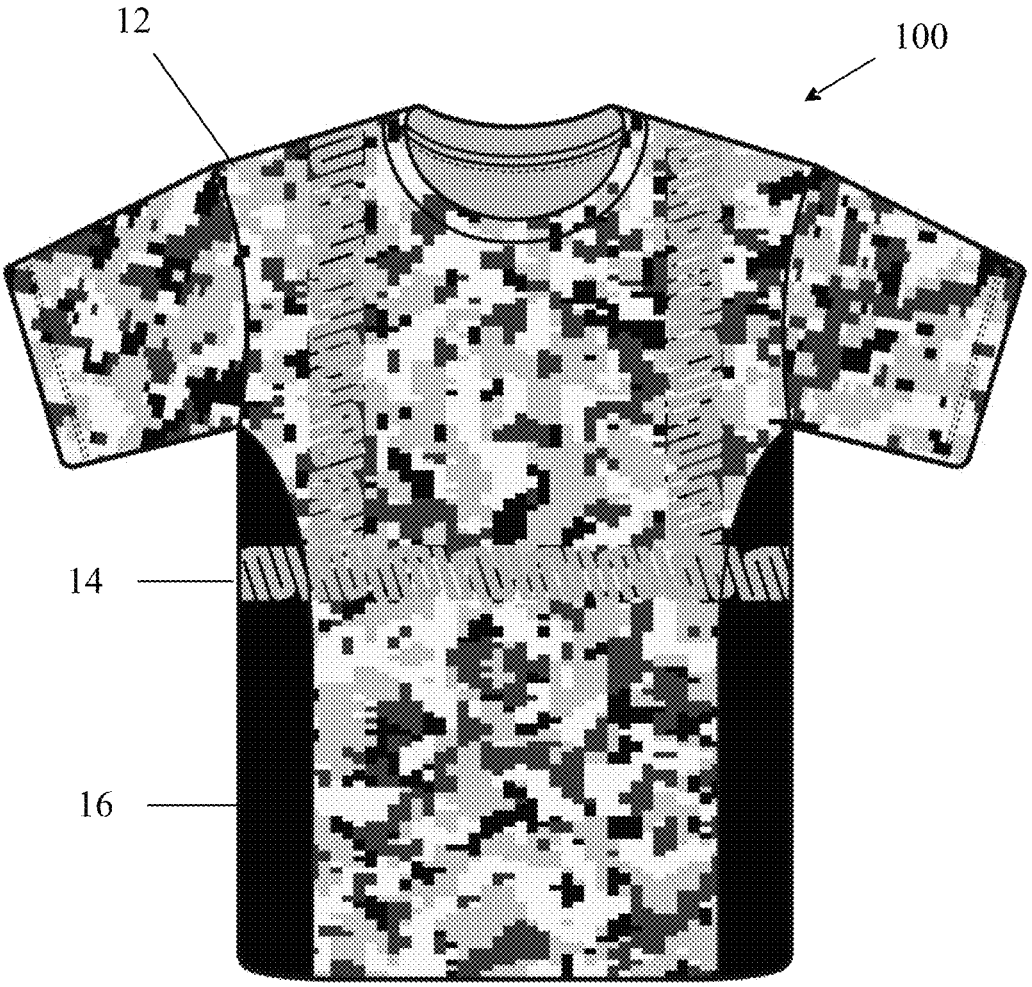
FIG. 4A depicts one embodiment of the present invention and illustrates a t-shirt with a first design comprising a pixelated pattern with varying degrees of yellow-green fluorescent material, a second design comprising three bands of reflective material around the upper torso, wherein each band is comprised of a repeating SS® logo, and a third design comprising two black side panels.

FIG. 4A illustrates still another embodiment of the invention where reflective bands and bright coloring are grouped with a pixelated pattern on a t-shirt 100. U.S. patent application Ser. No. 09/986,016 for Santos et al. that apparently discloses a camouflage pattern that depends on the use of a macro-pattern resulting from a repeat of a micro-pattern, with an objective of optimizing improved concealment of the wearer. In contrast, the pixelated print of the first design 12 of FIG. 4A is a pattern of varying degrees of yellow-green fluorescent material such that the wearer is more conspicuous and noticeable from the surroundings, rather than concealed. The t-shirt 100 further comprises a second design 14 comprising reflective material in a layout similar to previous embodiments, and a third design 16 comprising two black side panels.

In other embodiments, the t-shirt may have one or more pockets, which may or may not comprise the same design pattern as the first design 12. In other embodiments, the t-shirt 100 may have fourth or fifth designs that accent the shoulders, sleeves, or lower torso. Additionally, the colors shown in FIG. 4A and other embodiments may also vary. Furthermore, in embodiments not shown here, the configurations of the first design 12 (fluorescent pattern) and second design 14 (reflective band) may be grouped on a variety of apparel items, including but not limited to gloves, helmets, hoodies, hats, vests, shoes, pants, belts, and the like. One skilled in the art would understand that the structure and concept of creating aesthetically-pleasing and ANSI-certifying every-day wear can be applicable to all apparel and garments.

Figure 4B:
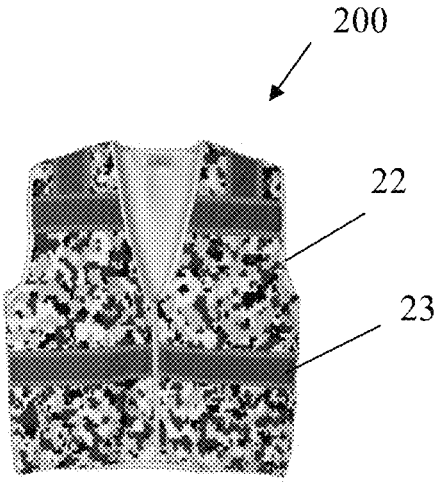
FIG. 4B depicts another embodiment of the present invention and illustrates a vest with a first design comprising a pixelated pattern with varying degrees of green fluorescent material, and a second design comprising four bands of combined-performance material around the upper torso.

FIG. 4B, for example, illustrates how one skilled in the art could modify the embodiment illustrated in FIG. 4A as a vest. In FIG. 4B, the vest 200 is shown to have a first design 22 that is also a pattern comprising pixelated and varying degrees of fluorescent material that is green rather than yellow-green; the second design 23 is solid reflective banding comprising combined-performance material, as opposed to solely reflective material or having a repeated micro-design; and the layout of the second design 23 is slightly different from the configuration of second design 14 in FIG. 4A.

Figure 5A:
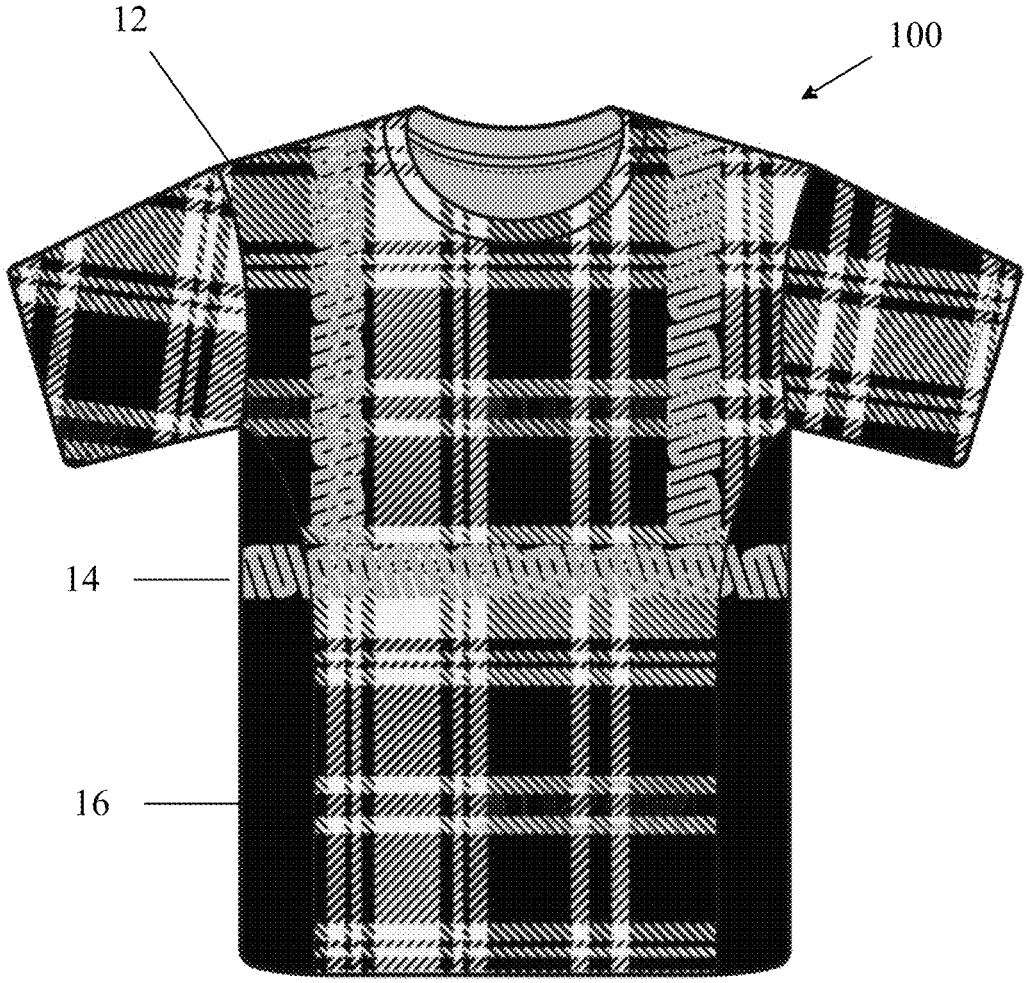
FIG. 5A depicts one embodiment of the present invention and illustrates a t-shirt with a first design comprising a plaid patterned yellow-green fluorescent material, a second design comprising three bands of reflective material around the upper torso, wherein each band is comprised of a repeating SS® logo, and a third design comprising two black side panels.

FIG. 5A illustrates an embodiment of the invention where reflective bands 14 and fluorescent material 12, such as yellow, for example, are grouped into plaid and striped patterns on a t-shirt 100, with black side panels 16. Combining elements of high-visibility with fashionable plaid textile or graphic designs achieves the unique dual function provided by embodiments of the present invention.

Figure 5B:
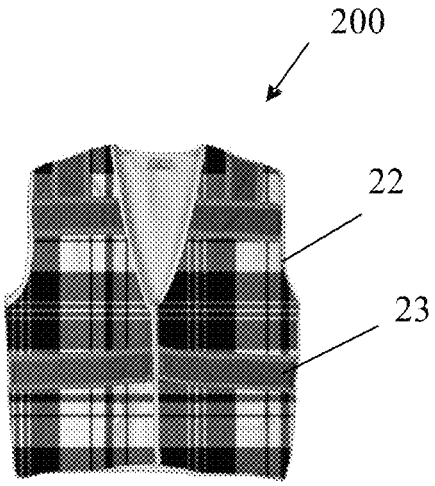
FIG. 5B depicts another embodiment of the present invention and illustrates a vest with a first design comprising a plaid patterned green fluorescent material, and a second design comprising four bands of combined-performance material around the upper torso.

FIG. 5B illustrates an alternate embodiment of the invention where reflective bands and bright coloring are grouped into plaid and striped patterns on a vest, similar to the embodiment illustrated in FIG. 5A, but with different colors and configurations in its reflective banding. The vest 200 illustrated in FIG. 5B, for example, may be worn by a user during activities such as, including but not limited to, walking, running, biking, and hiking, where safety apparel is optional. Alternatively, the vest illustrated in FIG. 5H may also be worn in industrial settings (e.g., construction, logging, marine, emergency medical services), where said apparel is either required or recommended. Companies, both large and small, in such industries where high-visibility apparel is beneficial or required, will likely have much higher rates of compliance and more willingness from employees and/or participants to agree to such internal and/or external safety programs. Employers and/or employees may also be able to save money on work attire due to the dual purpose of the embodiments of the present invention. Additionally, embodiments of the present invention present more choices to the user.

Figure 6A:
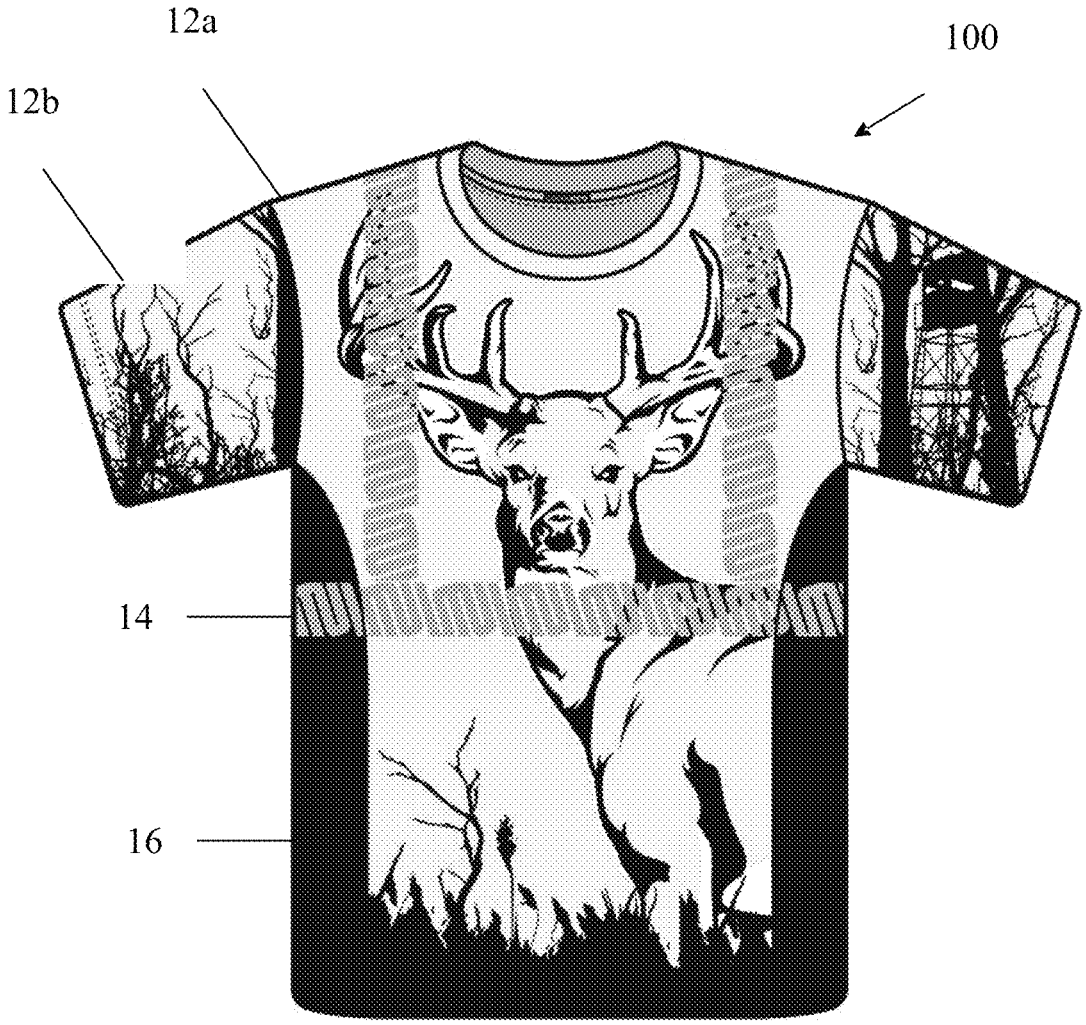
FIG. 6A depicts one embodiment of the present invention and illustrates a t-shirt with a first design comprising yellow-green fluorescent material with a caricature of a stag in a forest, a second design comprising three bands of reflective material around the upper torso, wherein each band is comprised of a repeating SS® logo, and a third design comprising two black side panels.

Lifestyle type images can also be integrated into the body of the garment such as outdoor scenes, cars, animals, sayings, heavy equipment, etc. FIG. 6A illustrates another embodiment of the invention where reflective bands 14 and fluorescent material, such as yellow, for example, are grouped with a picture of a deer 12*a* on at-shirt, with dark panels 16 along the sides and further designs on the sleeves 12*b*. FIG. 6A is an example of the amount of detail and variation that may be incorporated into embodiments of the present invention. In this embodiment, for example, the first design can be comprised of a simpler outline of a stag in the forest on the main bodice of the garment, and have more detailed outlines of trees and electric towers on the sleeves of the garment. The present invention may incorporate high-visibility elements into any picture desired by the manufacturer or the user. One skilled in the art would also understand that any picture desired can also be adjusted with more or less fluorescent material in order to comply with ANSI/ISEA standards.

Figure 6B:
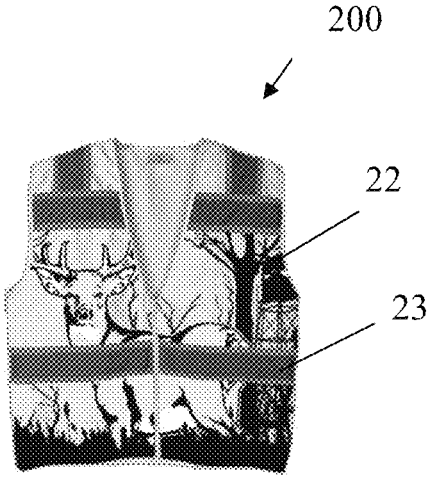
FIG. 6B depicts another embodiment of the present invention and illustrates a vest with a first design comprising green fluorescent material with a caricature of a stag in a forest, and a second design comprising four bands of combined-performance material around the upper torso.

FIG. 6B illustrates an alternate embodiment of the invention and shows a vest 200 with a different configuration of high-visibility elements (e.g., reflective banding 23 and fluorescent background material 22) incorporated into the design and picture as seen in FIG. 6A.

In other embodiments, the reflective bands may form and/or complement a visible logo, alphabet, stripes or other graphic shapes. Any repeating pattern designs like tire tracks, chevrons, letters, numbers or words, can be worked into the body of the garment and/or the reflective banding.

Figure 7A:
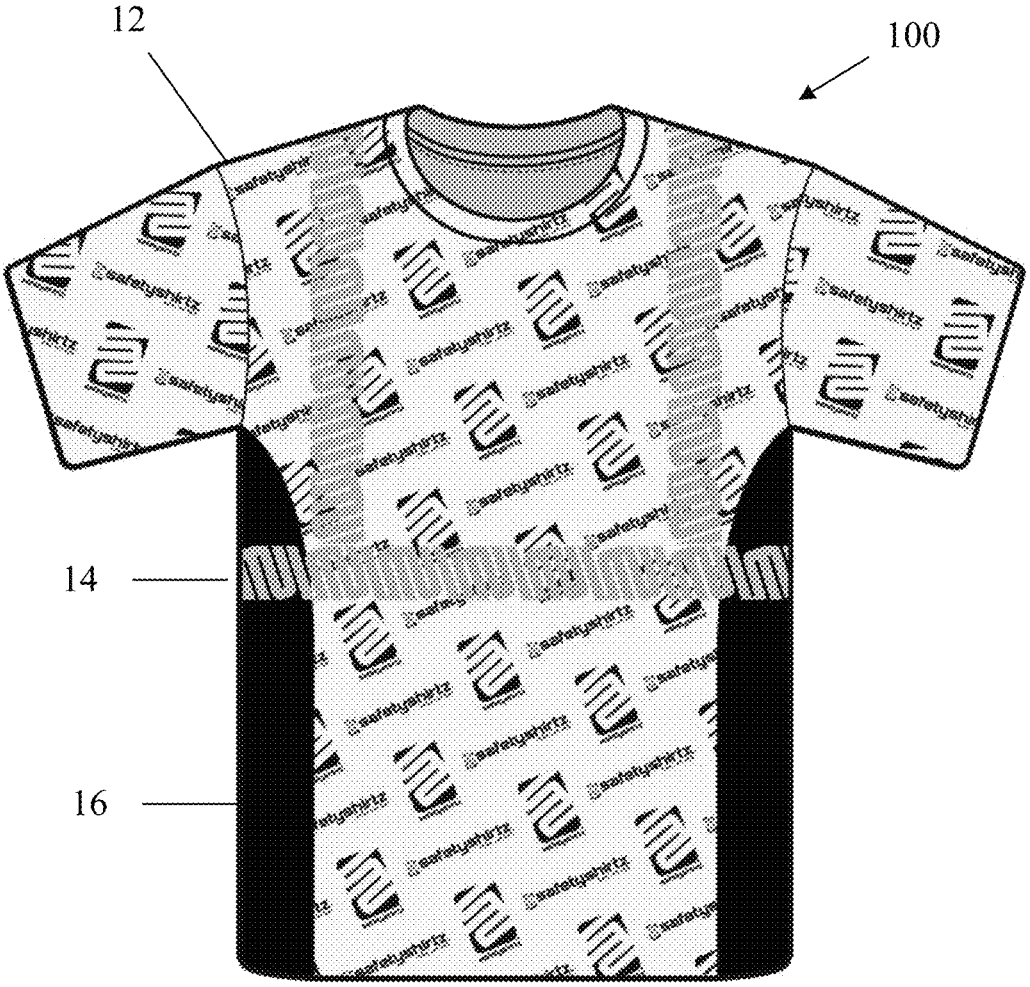
FIG. 7A depicts one embodiment of the present invention and illustrates a t-shirt with a first design comprising yellow-green fluorescent material with an all-over repeating SS® logo print, a second design comprising three bands of reflective material around the upper torso, wherein each band is comprised of a repeating SS® logo, and a third design comprising two black side panels.

For example, in FIG. 7A, both the body 12 of the t-shirt and the reflective banding 14 bear the pattern of the Safetyshirtz® SS® logo. (SafetyShirtz® and SS® are trademarks of SafetyShirtz.) Alternatively, in FIG. 7B, the Safetyshirtz logo is only present in the main pattern of the vest 200, while the reflective bands 23 are two-toned solid blocks of color.

Figure 7B:
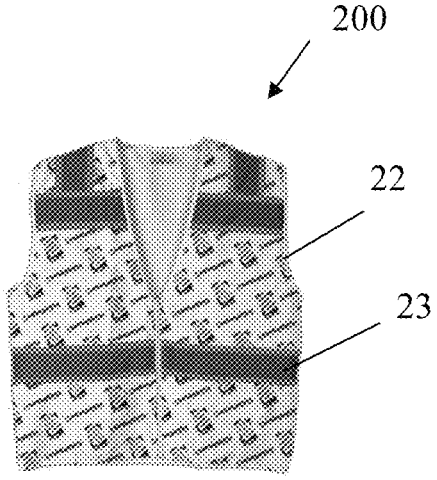
FIG. 7B depicts another embodiment of the present invention and illustrates a vest with a first design comprising green fluorescent material with an all-over repeating SS® logo, and a second design comprising four bands of combined-performance material around the upper torso.

FIG. 7A illustrates an embodiment 100 comprising a first design 12 with an all-over repeating logo on a solid yellow fluorescent material, a second design 14 comprising one horizontal band and two vertical bands of repeating SS® logos; and a third design 16 comprising two black side panels. FIG. 7B illustrates another embodiment 200 comprising a first design 22 with an all-over repeating logo on a solid green fluorescent material, and a second design 23 comprising one horizontal band and two vertical bands of combined-performance material.

Figure 8A:
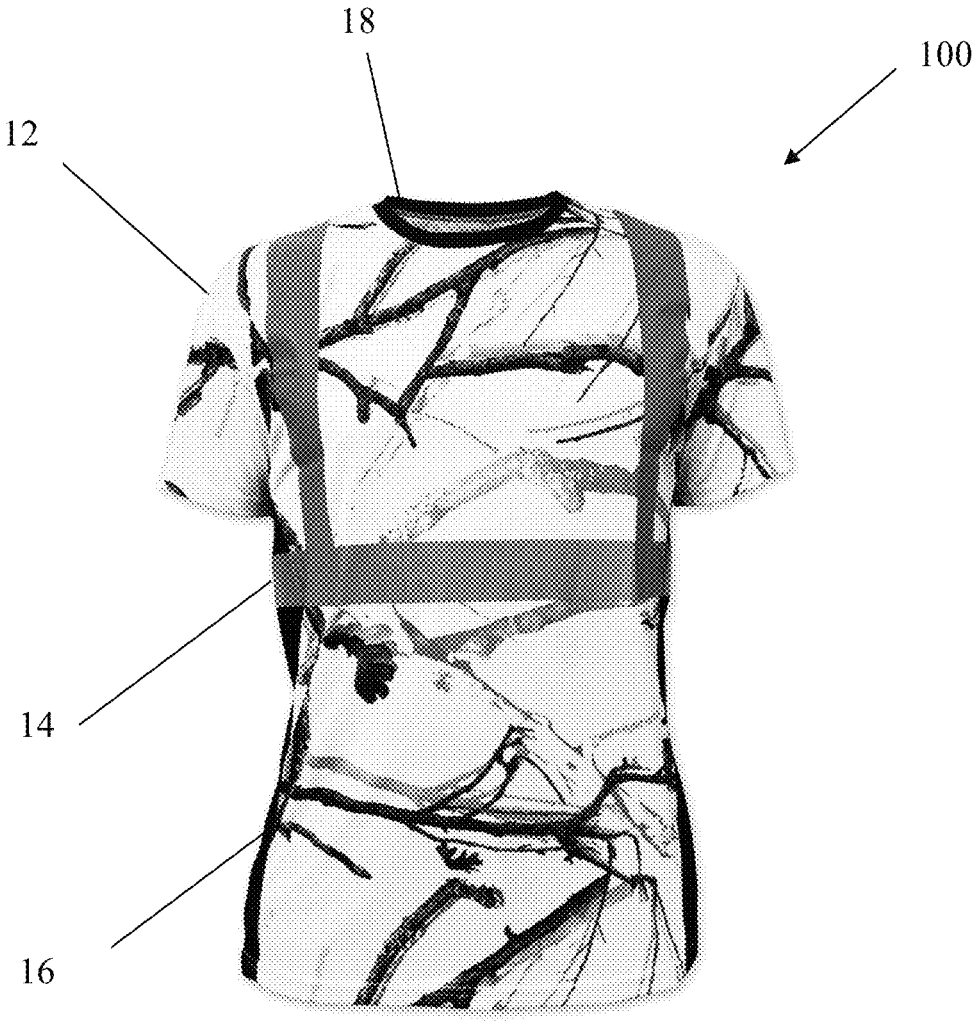
FIG. 8A depicts one embodiment of the present invention and illustrates at-shirt with a first design comprising yellow-green fluorescent material with an all-over tree branch print, a second design comprising three solid bands of reflective material around the upper torso, and a third design comprising two black side panels and black-lined collar.

FIG. 8A depicts one embodiment of the present invention and illustrates at-shirt 100 with a first design 12 comprising yellow-green fluorescent material with an all-over tree branch print (similar to that of FIG. 1A), and a second design 14 comprising three solid bands of reflective material around the upper torso. As shown, a third design 16 comprising two black side panels could be added and a fourth design 18 of a black-lined collar can also be present.

Figure 8B:
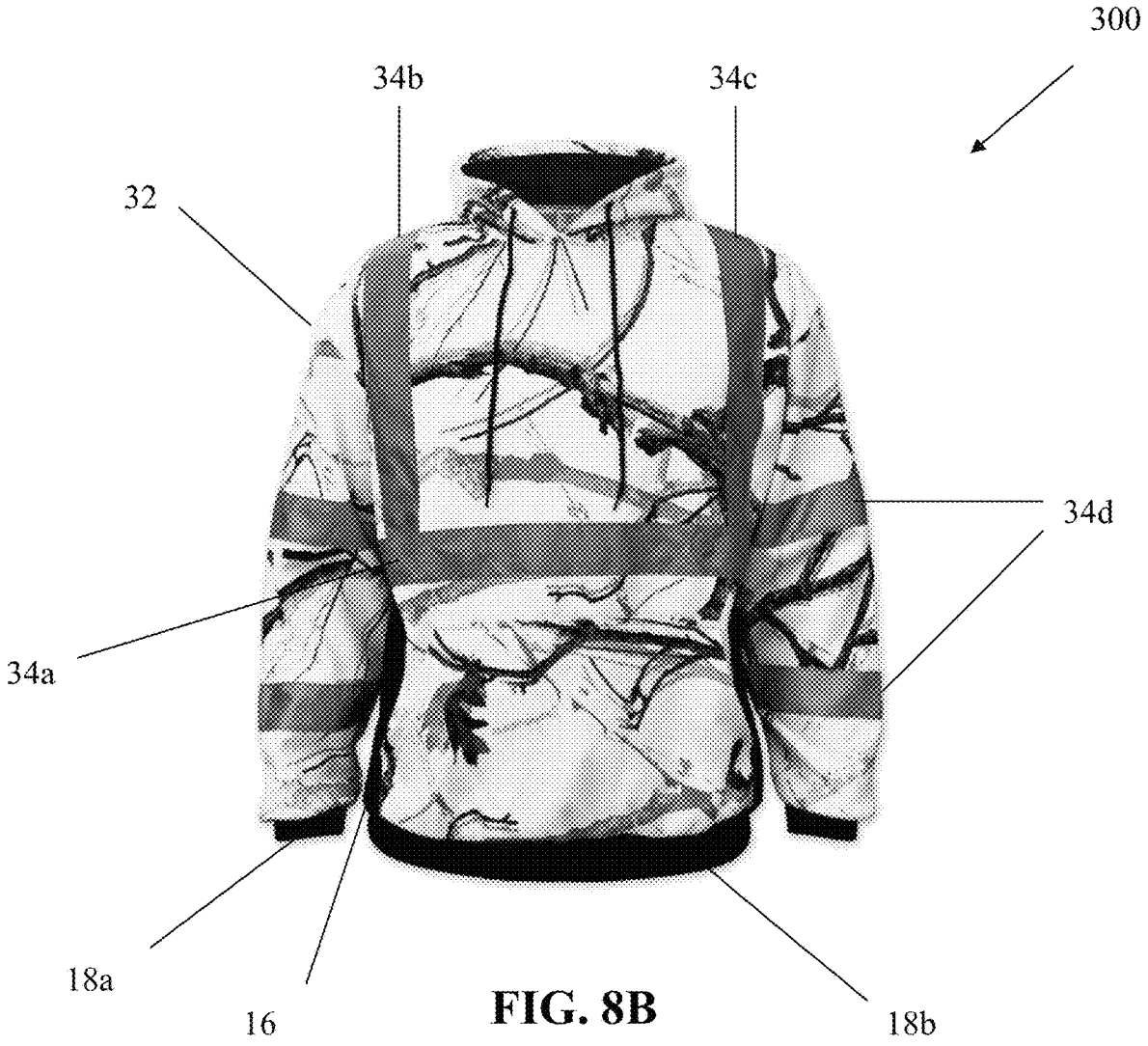
FIG. 8B depicts another embodiment of the present invention and illustrates a hooded sweatshirt with a first design comprising yellow-green fluorescent material with an all-over tree branch print, a second design comprising three solid bands of reflective material around the upper torso and two solid bands around each sleeve, and a third design comprising two black side panels and black-lining along the cuffs and waist.

FIG. 8B depicts another embodiment of the present invention and illustrates a hooded sweatshirt 300 with a first design 32 comprising yellow-green fluorescent material with an all-over tree branch print; a second design comprising three solid bands of reflective material around the upper torso (one horizontal band 34*a* encircling the torso, a first vertical band 34*b* joining the horizontal band 34*a* from front to back along the right shoulder, and a second vertical band 34*c* joining the horizontal band 34*a* from front to back along the left shoulder) and two solid bands 34*d* around each sleeve, and a third design comprising, for example, two black side panels 16 and black-lining along the cuffs 18*a* and waist 18*b*.

Figure 8C:
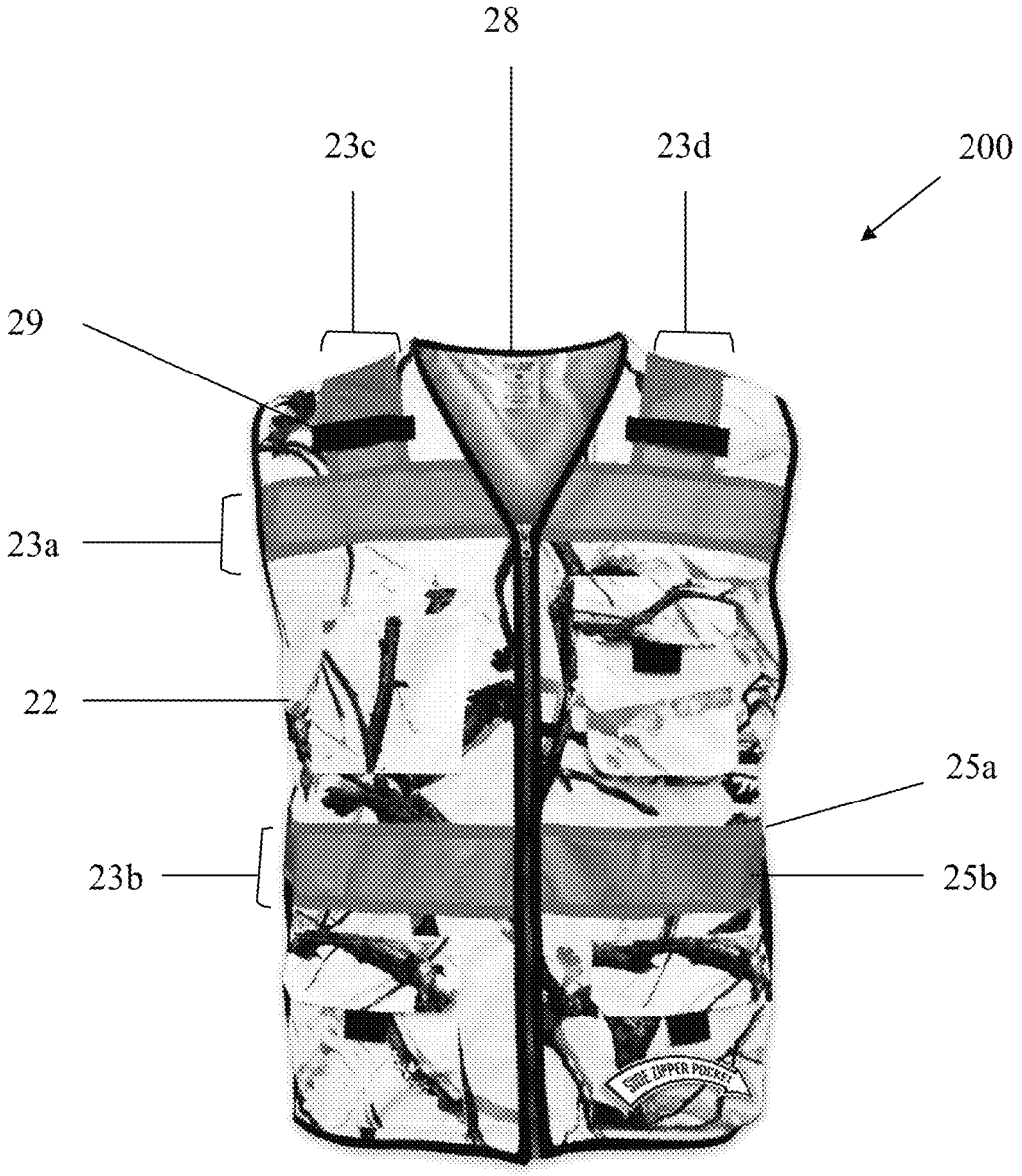
FIG. 8C depicts yet another embodiment of the present invention and illustrates a vest with a first design comprising yellow-green fluorescent material with an all-over tree branch print, a second design comprising four bands of combination-performance material around the upper torso, and a third design of black piping along the vest and zipper.

FIG. 8C depicts yet another embodiment of the present invention and illustrates a vest 200 with a first design 22 comprising yellow-green fluorescent material with an all-over tree branch print; a second design comprising four bands of combination-performance material around the upper torso; and a third design of black accents 29 and black piping 28 along the vest and zipper. As seen in other embodiments disclosed herein, the combined-performance material comprises a reflective band 25*b* sandwiched between two thinner bands 25*a* of orange-red fluorescent material. In this embodiment, the configuration of the combined-performance material comprises a first horizontal band 23*a* encircling the upper torso, a second horizontal band 23*b* encircling the lower section of the torso, and a third band 23*c* and fourth band 23*d* that each join the first horizontal band 23*a* from the front to the back over each shoulder in a vertical configuration. One skilled in the art would understand that different configurations and patterns could be placed on the garment. FIG. 8C also illustrates that the garment can include pockets, side zipper pockets, and other aesthetic and utilitarian components. Other designs could be placed on such pockets, zippers, and the like to add to the high-visibility and/or aesthetic qualities of the garment.

Figure 9A:
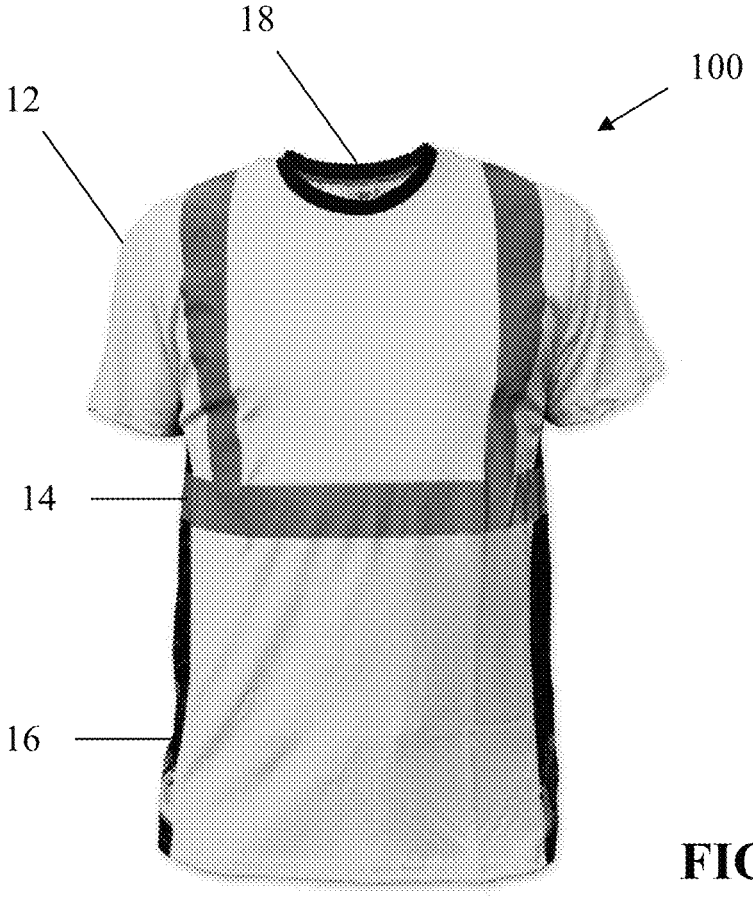
FIG. 9A depicts one embodiment of the present invention and illustrates at-shirt with a first design comprising a solid block of green fluorescent material, a second design comprising three solid bands around the upper torso, a third design comprising two side panels, and a fourth design comprising a dark blue-lined collar.

FIG. 9A depicts one embodiment of the present invention and illustrates at-shirt 100 with a first design 12 comprising a solid block of green fluorescent material; a second design 14 comprising three solid bands of reflective material around the upper torso; a third design 16 comprising side panels of a bald eagle illustration for a pop of color and accent/detail; and a fourth design comprising a dark blue-lined collar 18.

Figure 9B:
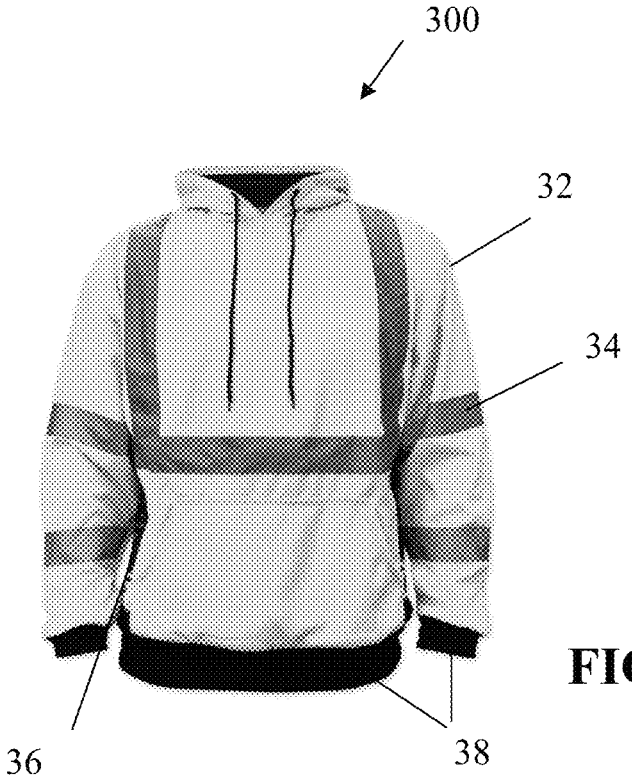
FIG. 9B depicts another embodiment of the present invention and illustrates a hooded sweatshirt with a first design comprising a panel of solid block of green fluorescent material, a second design comprising several solid bands of reflective material, a third design comprising two side panels, and a fourth design comprising dark blue lining along the cuffs and waist.

FIG. 9B depicts another embodiment of the present invention and illustrates a hooded sweatshirt 300 with a first design 32 comprising a solid block of green fluorescent material; a second design 34 comprising three solid bands of reflective material around the upper torso and two solid bands around each sleeve for a total of 7 reflective bands; a third design 36 comprising the same bald eagle artwork as shown in FIG. 9A as accented side panels; and a fourth design comprising a dark blue-lining 38 along the cuffs and waist. One skilled in the art can appreciate that the embodiment illustrated in FIG. 9B can further comprise fifth and sixth designs to provide additional background, fluorescent, or reflective materials in a variety of different ways.

Figure 9C:
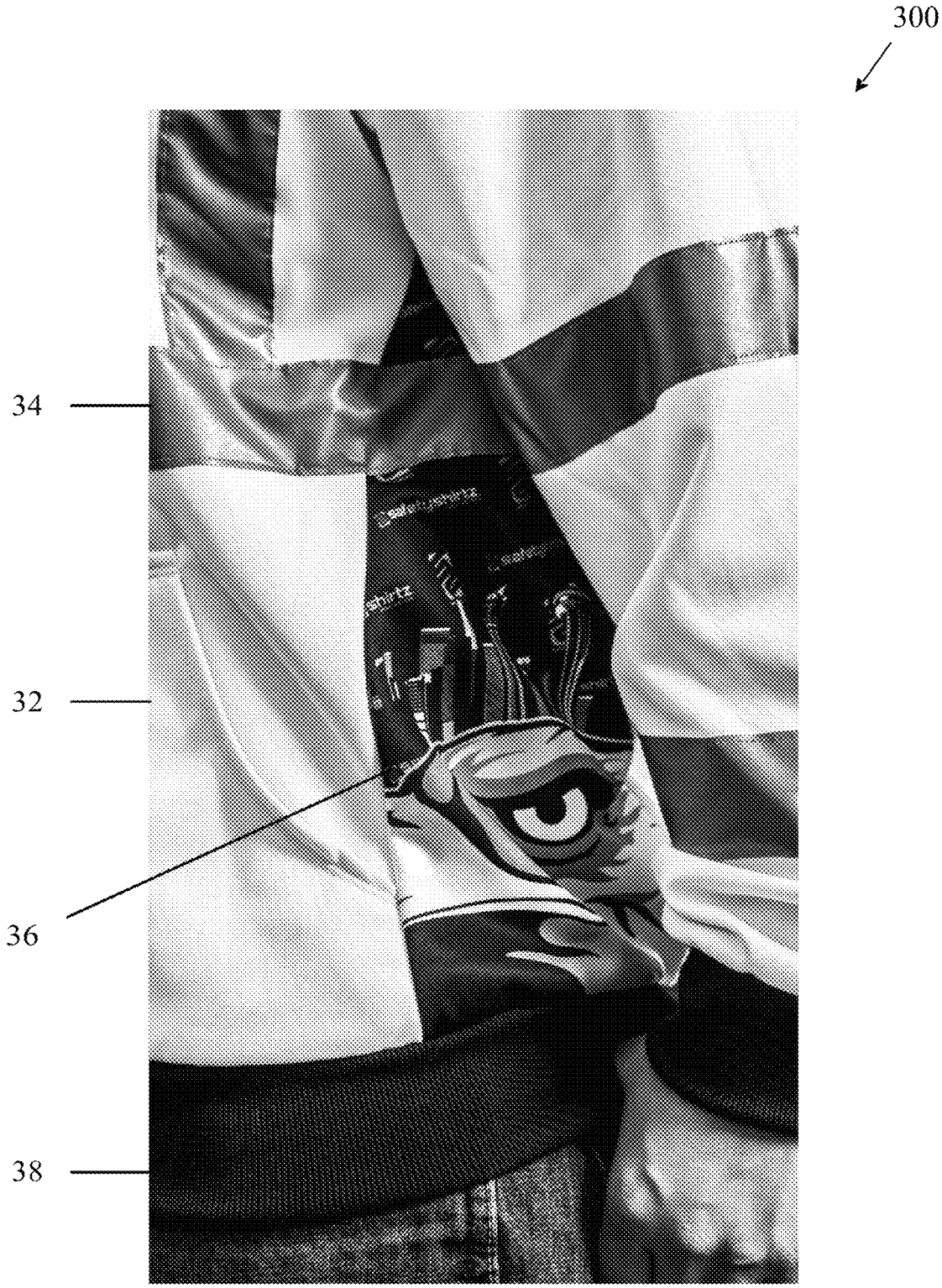
FIG. 9C depicts yet another embodiment of the present invention and provides a magnified view of a portion of the hooded sweatshirt illustrated in FIG. 9B with a first design comprising a solid block of green fluorescent material, a second design comprising several solid bands of reflective material around the upper torso and sleeves, a third design comprising two side panels illustrating artwork that depicts a bald eagle with a Seattle skyline and repeating Safetyshirtz® logo print, and a fourth design comprising dark blue lining along the cuffs and waist.

FIG. 9C provides a magnified view of the third design side panel 36 of the hooded sweatshirt 300 illustrated in FIG. 9B. The illustration in FIG. 9C shows the first design 32 comprising a panel of a solid block of green fluorescent material; a second design 34 comprising several solid bands of reflective material around the upper torso; a third design 36 comprising two solid bands around each sleeve; and a fourth design comprising two side panels of artwork that depict a bald eagle with a Seattle skyline and repeating Safetyshirtz® logo print; and dark blue lining 38 along the cuffs and waist. One skilled in the art could appreciate that the third design 36 along the side panels could reflect other illustrations and artwork, such as sports team, comic books, or any other image desired. In particular, this embodiment demonstrates how much creativity and expression is available to the designer and wearer. Not only can wearers be comfortable and expressive in their choice of high-visibility apparel that is not currently available under the status quo, but companies like sports teams and other businesses have a new avenue for marketing, branding, and advertising.

Figure 10:
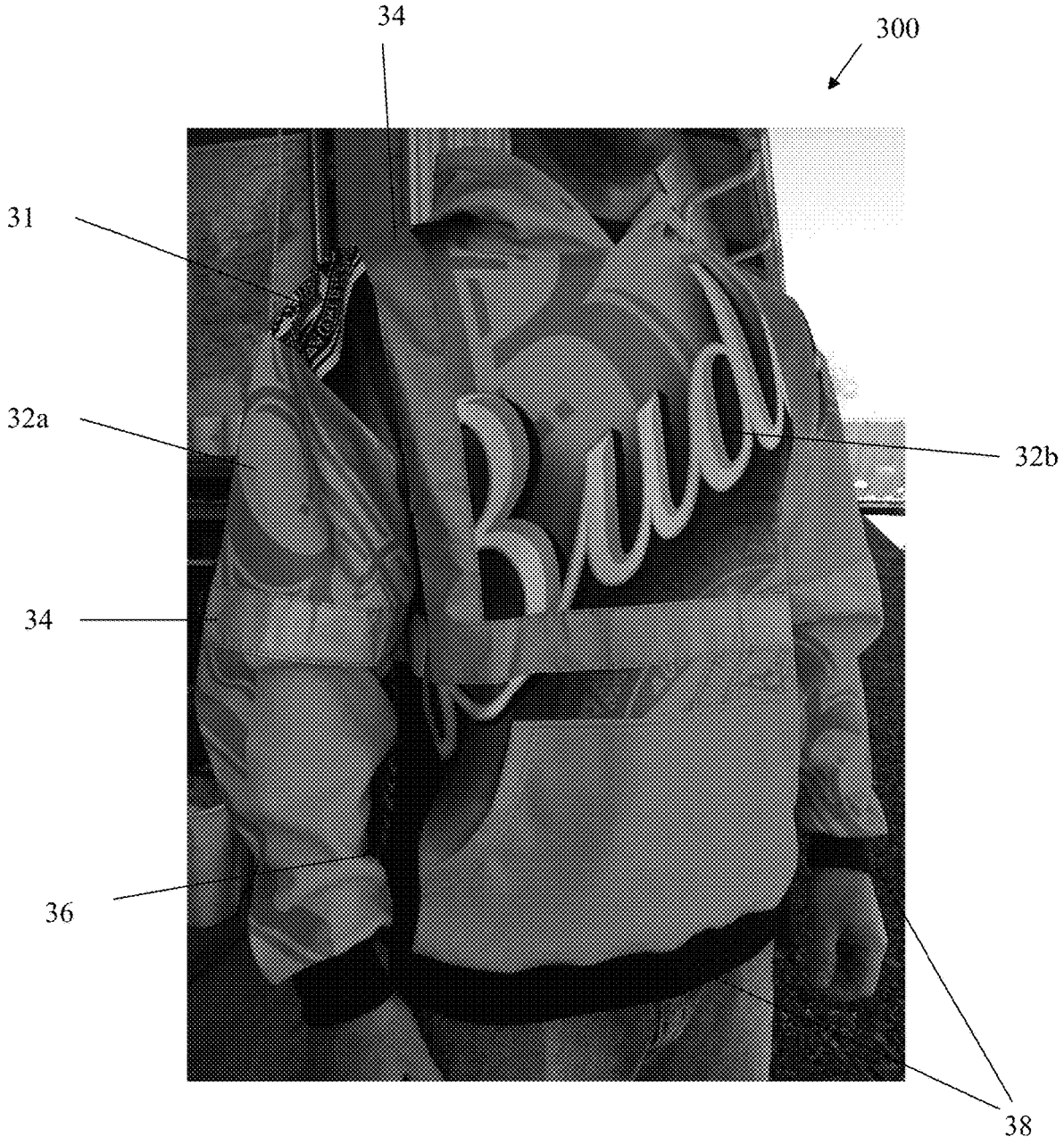
FIG. 10 illustrates a hood sweatshirt with a first design comprising orange-red fluorescent material with a prominent Budweiser® logo across the chest and less prominent logos/shading along the sleeves and bodice, a second design comprising three solid bands of reflective material around the upper torso and one single solid band around each sleeve, a third design comprising two shoulder panels with Budweiser® art, and a fourth design comprising two black side panels, and a fifth design comprising black-lining along the cuffs and waist.

FIG. 10 is an example of branding and design via an embodiment of the present invention. FIG. 10 illustrates a hood sweatshirt 300 with a first design comprising orange-red fluorescent material with a prominent Budweiser® logo 32*b* across the chest and less prominent logos/shading 32*a* along the sleeves and bodice; a second design 34 comprising three solid bands of reflective material around the upper torso and one single solid band around each sleeve; a third design 31 comprising two shoulder panels with Budweiser® art; a fourth design 36 comprising two black, for example, side panels; and a fifth design 38 comprising black-lining along the cuffs and waist. In another embodiment, there may not be a fourth design 36, and instead, the first design can span the entire lower part of the garment. Alternatively, the materials and designs used in the side panel for the fourth design 36 may be identical to the materials and design used in the shoulder panels for the third design. The independent elements disclosed in this application can be combined in various ways to form an aesthetic and high-visibility garment.

Figure 11:
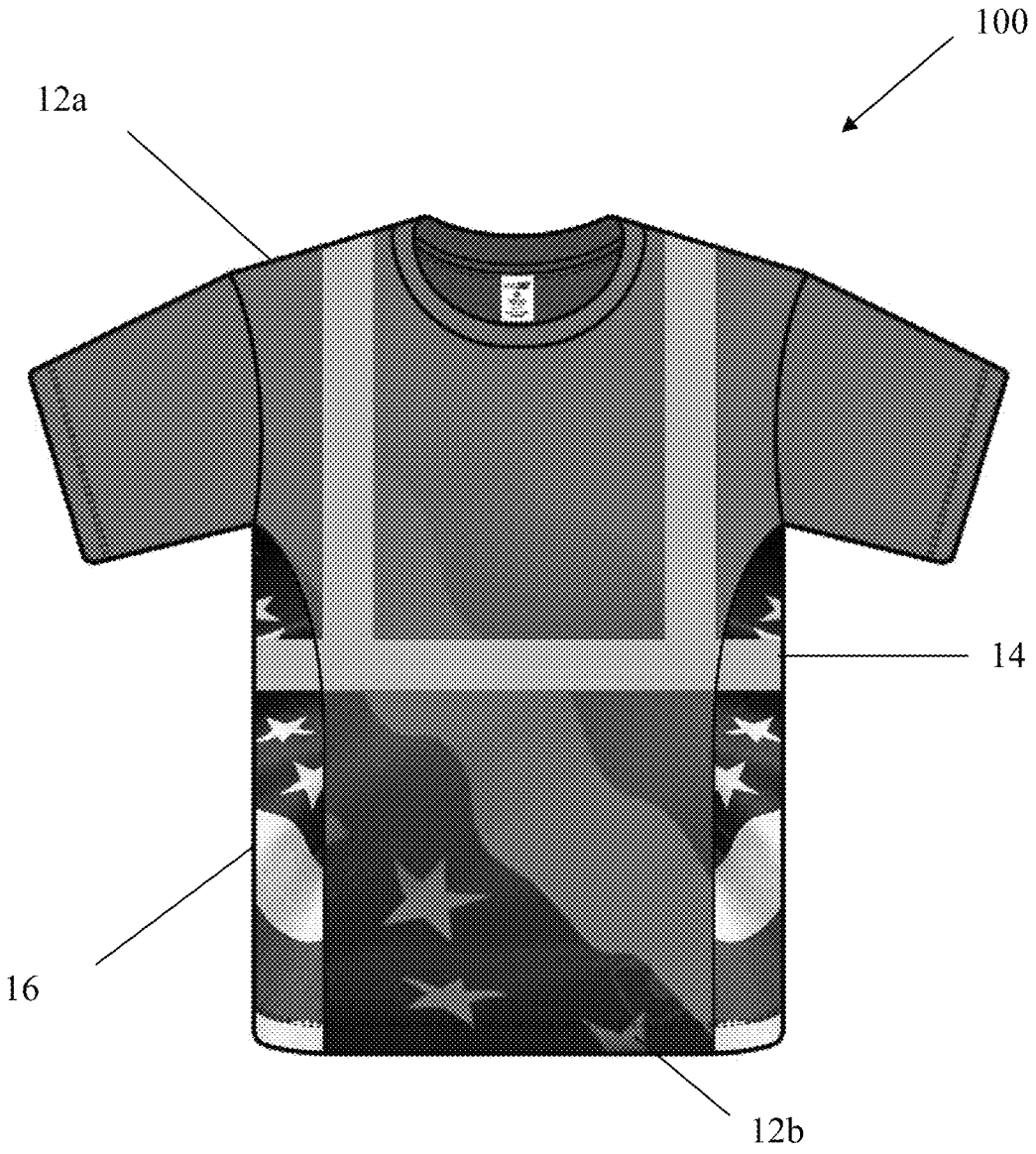
FIG. 11 depicts one embodiment of the present invention and illustrates a t-shirt with a first design comprising orange-red fluorescent material with a silhouetted American flag along the lower torso, a second design comprising three solid bands of reflective material around the upper torso, and a third design comprising two side panels depicting the colors of the American flag.

FIG. 11 depicts another embodiment of the present invention and illustrates a t-shirt 100 with a first design comprising orange-red fluorescent material 12*a* with a silhouetted American flag 12*b* along the lower torso; a second design 14 comprising three solid bands of reflective material around the upper torso; and a third design 16 comprising two side panels depicting the colors of the American flag. One skilled in the art would understand that anyone required or wishing to wear high-visibility apparel during certain American holidays would be afforded with the choice of wearing this embodiment rather than generic and un-styled conventional high-visibility apparel.

Figure 12:
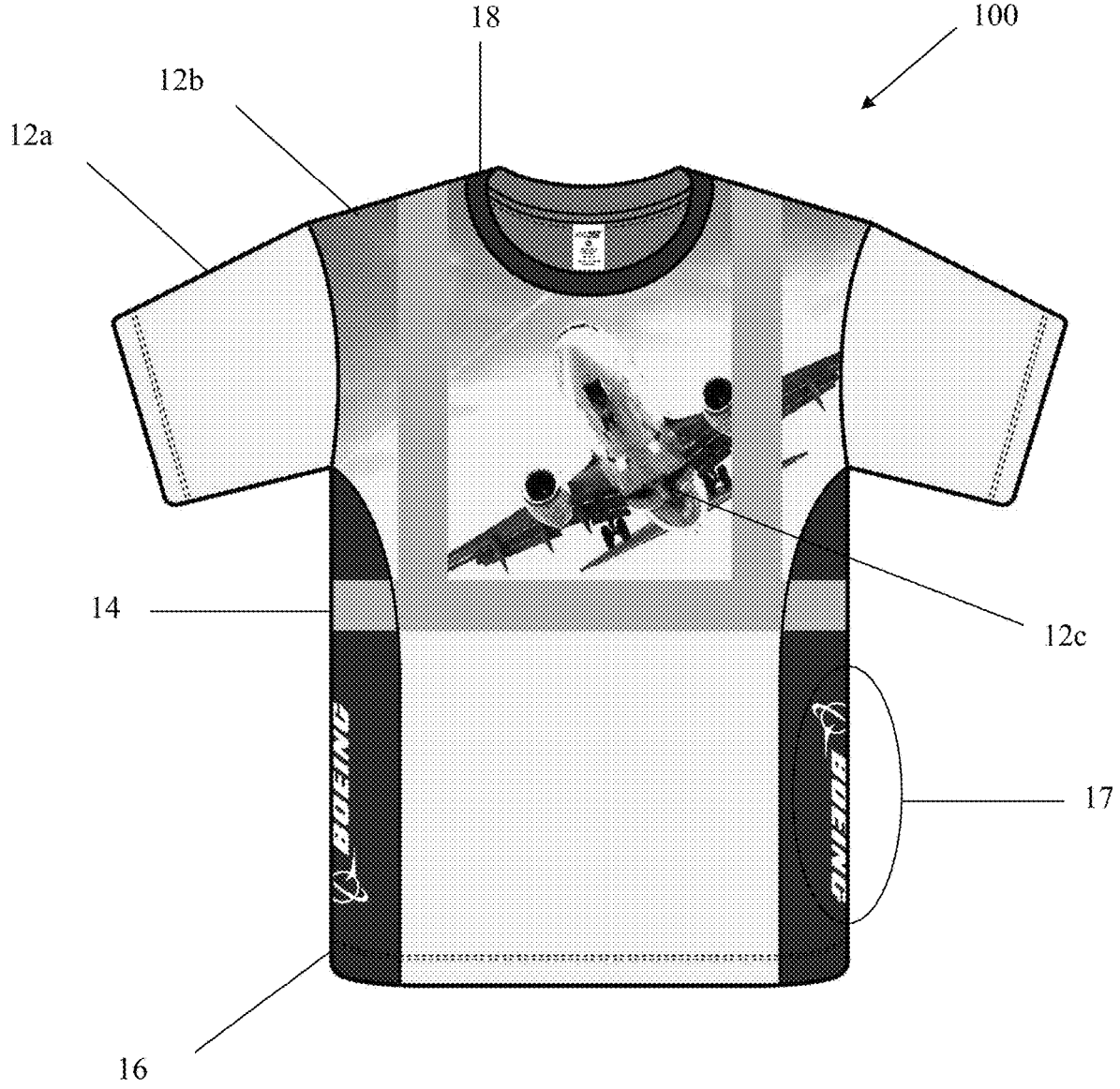
FIG. 12 depicts one embodiment of the present invention and illustrates at-shirt with a first design comprising yellow-green fluorescent material with a picture of an airplane along the upper torso, a second design comprising three solid bands of reflective material around the upper torso, a third design comprising two blue side panels and blue-lined collar, and a fourth design comprising the Boeing® logo overlaid on each side panel.

FIG. 12 depicts yet another embodiment of the present invention and illustrates a t-shirt 100 with a first design comprising yellow-green fluorescent material 12*a* with some shading 12*b* for added aesthetics and accents and a picture of an airplane 12*c* along the upper torso; a second design 14 comprising three solid bands of reflective material around the upper torso; a third design comprising two blue side panels 16 and blue-lined collar 18; and a fourth design comprising the Boeing® logo 17 overlaid on each side panel.

Figure 13:
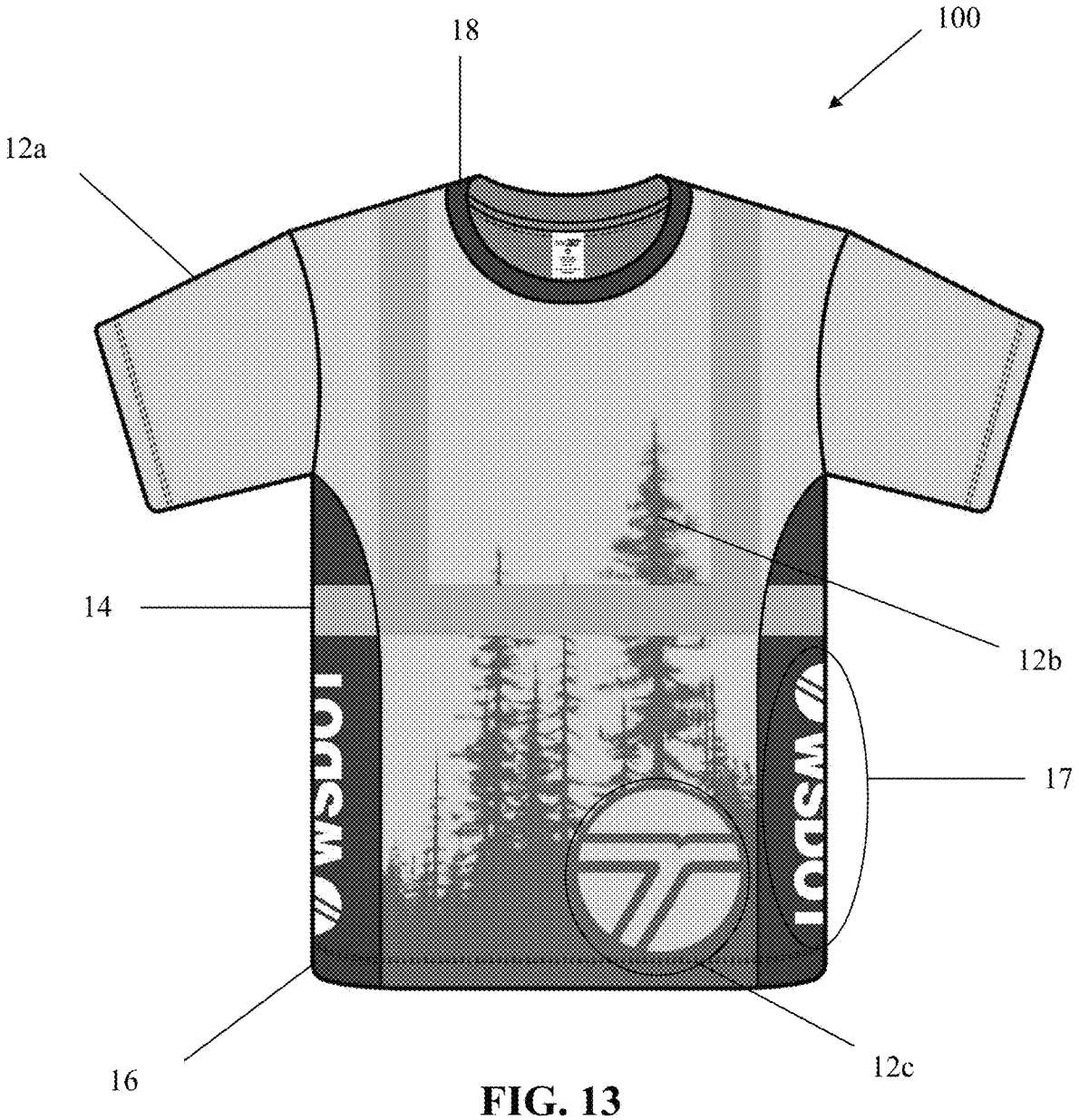
FIG. 13 depicts one embodiment of the present invention and illustrates a t-shirt with a first design comprising green fluorescent material with silhouettes of trees along the bottom torso, a second design comprising three solid bands of reflective material around the upper torso, a third design comprising two dark green side panels and dark green-lined collar, and a fourth design comprising the Washington State Department of Transportation ("WSDOT") logo overlaid on each side panel.

FIG. 13 depicts yet another embodiment of the present invention and illustrates a t-shirt 100 with a first design comprising green fluorescent material 12*a* with silhouettes of trees along the bottom torso 12*b* and a WSDOT symbol 12*c* on the front lower left corner of the garment; a second design 14 comprising three solid bands of reflective material around the upper torso; a third design comprising two dark green side panels 16 and dark green-lined collar 18; and a fourth design comprising the WSDOT logo 17 overlaid on each side panel.

Together, FIGS. 12 and 13 demonstrate the range of new and improved uniforms, work wear, and/or customized apparel that may be provided through embodiments of the present invention.

Figure 14:
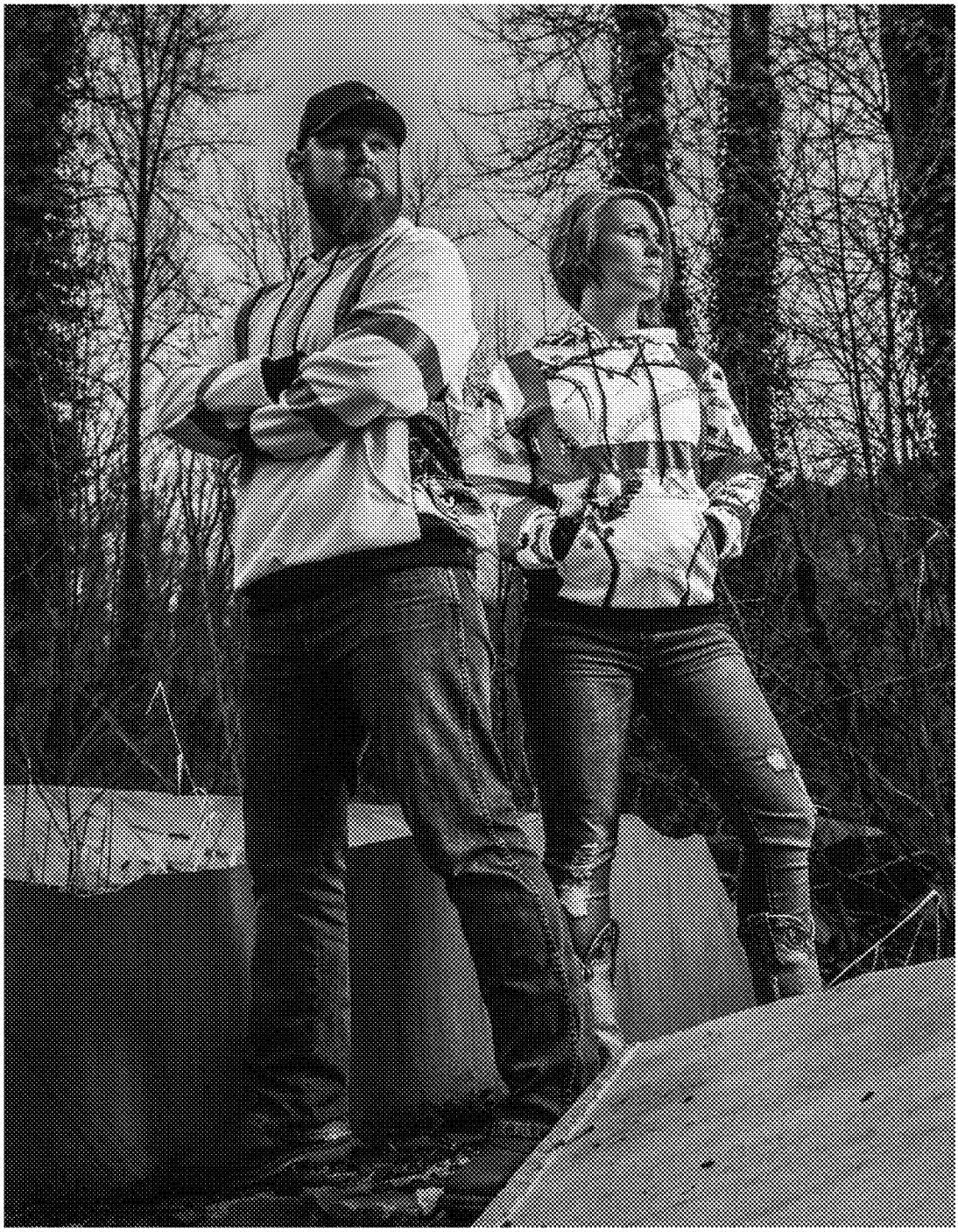
FIG. 14 illustrates schematically, the environment for the embodiments of the present invention shown in FIGS. 8B, 9B, and 9C.

FIG. 14 illustrates schematically, one type of environment for the embodiments of the present invention shown in FIGS. 8B, 9B, and 9C.

Another embodiment of the present invention discloses a method for designing a high-visibility garment having the aesthetics to meet everyday clothing needs. The methods disclosed in this application can allow the garment to be self-certified by the manufacturer. One method comprises the steps of: creating a design, wherein the design is an artistic element and comprises a first partial design and a second partial design; transferring the first partial design to a clothing fabric using a fluorescent material; and transferring the second partial design to the clothing fabric using a material selected from the group consisting of a reflective material and a combined-performance material, wherein the materials independently or together provide external visibility of the wearer when the garment is worn by the wearer. One such method of transferring the design to the garment is via dye-sublimation technology. While dye-sublimation technology has been used in high-visibility apparel, dye-sublimation has not been used in apparel with reflective ANSI 2 and ANSI 3 qualifications. Other methods include, but are not limited to, printing, gluing, dyeing, stitching, ink-jet or iron-on. Transfer methods may be any technique currently known in the art or later discovered. Methods for creating/designing the present invention can include garments from a single piece of fabric to multiple pieces of fabric.

Another embodiment of the invention is a system of providing fashionable high-visibility everyday apparel to companies who have a need for such single integrated unitary garments, or employees or other participants/patrons of such a company. This application discloses a system of providing a single integrated unitary garment to a user, wherein the single integrated unitary garment comprises: a garment, wherein the garment comprises a clothing fabric; a first design on the garment, wherein the first design is externally visible when the garment is worn by a user; a second design overlaid on the first design to create a resulting design, wherein the resulting design comprises an artistic expression and causes the user to have 360 degree external visibility.

Similarly, this application also discloses a system of manufacturing a single integrated unitary garment, wherein the single integrated unitary garment comprises a garment, wherein the garment comprises a clothing fabric; a first design on the garment, wherein the first design is externally visible when the garment is worn by a user; a second design overlaid on the first design to create a resulting design, wherein the resulting design comprises an artistic expression and causes the user to have 360 degree external visibility.

One skilled in the art would understand that the disclosed systems can incorporate the different embodiments contemplated and/or disclosed in this application.

While a preferred embodiment of the invention has been illustrated and described, as noted above, many changes can be made without departing from the spirit and scope of the invention. Accordingly, the scope of the invention is not limited by the disclosure of a preferred embodiment. Instead, the invention should be determined entirely by reference to the claims that follow.

The embodiments of the invention in which an exclusive property or privilege is claimed are defined as follows:

We claim:

1. A short sleeve safety garment, comprising:

a first material that forms at least a torso of the safety garment, wherein the first material is at least partially formed of a fluorescent material;

a first short sleeve that extends from the torso;

a second short sleeve that extends from the torso;

a first design on the first material, wherein the first design is at least partially comprised of a second material different than the first material;

a first reflective material band that at least partially overlays the first design, the first reflective material band encircles the torso, wherein the first reflective material band is a contiguous, continuous, monolithic element about 2 inches in width;

a second reflective material band that extends from the first reflective material band on a front of the safety garment to the first reflective material band on a back of the safety garment, wherein the second reflective material band extends over a first shoulder of the safety garment, wherein the second reflective material band is a contiguous, continuous, monolithic element about 2 inches in width;

a third reflective material band that extends from the first reflective material band on the front of the safety garment to the first reflective material band on the back of the safety garment, wherein the third reflective material band extends over a second shoulder of the safety garment, wherein the third reflective material band is a contiguous, continuous, monolithic element about 2 inches in width;

a first side panel that interconnects the front and the back of the safety garment adjacent to the first short sleeve, the first side panel made of a material different than the first material;

a second side panel that interconnects the front and the back of the safety garment adjacent to the second short sleeve, the second side panel made of a material different than the first material;

a first side design on the first side panel, the first side design different than the first design; and a second side design on the second side panel, the second side design different than the first design, the first reflective material band at least partially extends over the first side design and the second side design.

2. The safety garment as recited in claim 1, wherein the first material is of a color selected from the group consisting of yellow, yellow-green, green, orange, orange-red, and red.

3. The safety garment as recited in claim 1, wherein the first material defines an area of at least seventy-eight inches squared (78 $in^2$) and the first, second and third reflective material bands define an area of at least ten inches squared (10 $in^2$).

4. The safety garment as recited in claim 1, wherein the first design is at least partially comprised of a camouflage pattern.

5. The safety garment as recited in claim 1, wherein the first design is at least partially formed of a fluorescent material and a reflective material.

6. The safety garment as recited in claim 1, wherein the second material is at least partially formed of a reflective material.

7. The safety garment as recited in claim 1, wherein the first side panel and the second side panel are made of a material that is black in color.

8. The safety garment as recited in claim 1, further comprising a solid black neck collar on the torso of the safety garment.

9. A short sleeve safety garment, comprising:

a first material that forms at least a torso of the safety garment, wherein the first material is at least partially formed of a fluorescent material;

a black-lined collar formed in the torso;

a first short sleeve that extends from the torso;

a second short sleeve that extends from the torso;

a first design on the first material, wherein the first design is at least partially comprised of a second material different than the first material, wherein the first design is at least partially comprised of a camouflage pattern;

a first reflective material band that at least partially overlays the first design, the first reflective material band encircles the torso, wherein the first reflective material band is a contiguous, continuous, monolithic element about 2 inches in width;

a second reflective material band that extends from the first reflective material band on a front of the safety garment to the first reflective material band on a back of the safety garment, wherein the second reflective material band extends over a first shoulder of the safety garment, wherein the second reflective material band is a contiguous, continuous, monolithic element about 2 inches in width;

a third reflective material band that extends from the first reflective material band on the front of the safety garment to the first reflective material band on the back of the safety garment, wherein the third reflective material band extends over a second shoulder of the safety garment, wherein the third reflective material band is a contiguous, continuous, monolithic element about 2 inches in width;

a first side panel that interconnects the front and the back of the safety garment adjacent to the first short sleeve, the first side panel made of a material different than the first material, the first reflective material band overlays the first side panel;

a second side panel that interconnects the front and the back of the safety garment adjacent to the second short sleeve, the second side panel made of a material different than the first material, the first reflective material band overlays the second side panel;

a first side design on the first side panel, the first side design different than the first design; and a second side design on the second side panel, the second side design different than the first design, the first reflective material band at least partially extends over the first side design and the second side design.

10. The safety garment as recited in claim 9, wherein the first design is at least partially formed of the first material and the second material.

11. The safety garment as recited in claim 9, wherein the second material is at least partially formed of a reflective material.

12. A short sleeve safety garment, comprising:

a first material that forms at least a torso of the safety garment, wherein the first material is at least partially formed of a fluorescent material;

a black-lined collar formed in the torso;

a first short sleeve that extends from the torso;

a second short sleeve that extends from the torso;

a first design on the first material, wherein the first design is at least partially comprised of a second material different than the first material;

a first reflective material band that at least partially overlays the first design, the first reflective material band encircles the torso, wherein the first reflective material band is a contiguous, continuous, monolithic element about 2 inches in width;

a second reflective material band that extends from the first reflective material band on a front of the safety garment to the first reflective material band on a back of the safety garment, wherein the second reflective material band extends over a first shoulder of the safety garment, wherein the second reflective material band is a contiguous, continuous, monolithic element about 2 inches in width;

a third reflective material band that extends from the first reflective material band on the front of the safety garment to the first reflective material band on the back of the safety garment, wherein the third reflective material band extends over a second shoulder of the safety garment, wherein the third reflective material band is a contiguous, continuous, monolithic element about 2 inches in width;

a first side panel that interconnects the front and the back of the safety garment adjacent to the first short sleeve, the first side panel made of a material that is black in color, the first reflective material band overlays the first side panel;

a second side panel that interconnects the front and the back of the safety garment adjacent to the second short sleeve, the second side panel made of a material that is black in color, the first reflective material band overlays the second side panel.

* * * * *